US012270179B2

(12) United States Patent
Young

(10) Patent No.: US 12,270,179 B2
(45) Date of Patent: Apr. 8, 2025

(54) SYSTEMS AND METHODS OF FORCE BALANCING FOR ACTUATORS OF A POWER MACHINE

(71) Applicant: Doosan Bobcat North America, Inc., West Fargo, ND (US)

(72) Inventor: Christopher Young, Fargo, ND (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 0 days.

(21) Appl. No.: 18/821,761

(22) Filed: Aug. 30, 2024

(65) Prior Publication Data

US 2025/0075463 A1 Mar. 6, 2025

Related U.S. Application Data

(60) Provisional application No. 63/580,063, filed on Sep. 1, 2023.

(51) Int. Cl.
*E02F 3/43* (2006.01)

(52) U.S. Cl.
CPC ..... *E02F 3/434* (2013.01)

(58) Field of Classification Search
CPC ..... E02F 3/434
See application file for complete search history.

(56) References Cited

U.S. PATENT DOCUMENTS 4,329,797 A * 5/1982 Shumaker ..... E02F 3/34 414/722
8,843,282 B2 * 9/2014 Atkinson ..... E02F 9/265 701/50
9,410,304 B2 * 8/2016 Taylor ..... E02F 3/431
11,142,885 B2 * 10/2021 Krieger ..... E02F 3/433
2006/0018715 A1 * 1/2006 Halonen ..... E01C 19/15 404/118
2016/0053460 A1 * 2/2016 Singh ..... E02F 9/2041 701/50
2016/0108602 A1 * 4/2016 Singh ..... E02F 3/432 701/50
2018/0305889 A1 * 10/2018 Schiwal ..... E02F 3/3686
2020/0283991 A1 * 9/2020 Krieger ..... E02F 3/433
2021/0270004 A1 9/2021 Durkin et al.
2022/0025607 A1 * 1/2022 Krieger ..... E02F 3/3414
2023/0060424 A1 3/2023 Durkin

OTHER PUBLICATIONS

International Searching Authority, International Search Report and Written Opinion issued for corresponding International Application No. PCT/US2024/044849 mailed Dec. 16, 2024 [10 pgs].

* cited by examiner

*Primary Examiner* — Tyler J Lee
(74) *Attorney, Agent, or Firm* — Quarles & Brady LLP

(57) ABSTRACT

Force balancing can be implemented for actuators of an electric power machine. A method may include receiving a command for movement of a work element using a first electric actuator and a second electric actuator of the electric power machine and determining a target electric current based on the command for movement. The method may also include controlling the movement of the work element based on the target electric current, including providing substantially equal electric current to each of the first and second electric actuators to substantially balance forces exerted by the first and second electric actuators on the work element.

20 Claims, 11 Drawing Sheets

SYSTEMS AND METHODS OF FORCE BALANCING FOR ACTUATORS OF A POWER MACHINE

CROSS-REFERENCE TO RELATED APPLICATIONS

This application claims priority to U.S. Provisional Patent Application No. 63/580,063, filed Sep. 1, 2023, the entirety of which is incorporated by reference herein.

BACKGROUND

This disclosure is directed toward power machines. More particularly, the present disclosure is directed to power machines that operate in whole or in part under electrical power. Power machines, for the purposes of this disclosure, include any type of machine that generates power for the purpose of accomplishing a particular task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

The discussion above is merely provided for general background information and is not intended to be used as an aid in determining the scope of the claimed subject matter.

SUMMARY OF THE DISCLOSURE

Some configurations of the disclosure are directed to implementing force balancing for power machines and, in particular, to providing force balancing such that a pair of electric actuators of electric power machines exert substantially balanced forces when acting on a common load. Configurations described herein can thus facilitate automated force balancing for electric power machines. Accordingly, the technology disclosed herein may provide an advantageous control scheme that enables electric actuator force balancing on an electric power machine with paired electric actuators.

In some examples, force balancing may be implemented by matching electric currents for the electric actuators. For instance, in some examples, a first electric actuator may be controlled via a velocity control scheme and a second electric actuator may be controlled via an electric current control scheme, where the electric current of the second electric actuator may be controlled based on an electric current of the first electric actuator. In other examples, electric currents of the paired electric actuators may be monitored for electric current differences between the actuators. In such examples, when an electric current difference is detected, one or more of the electric actuators may be controlled via a velocity control scheme, where electric current differences may be compensated for via velocity adjustments (e.g., increasing or decreasing velocity for one or more of the electric actuators based on the mismatched currents). In still other examples, the paired electric actuators may be controlled via an electric control scheme, where a commanded movement can be implemented by using the same electric current to control each of the paired electric actuators.

Some configurations of the present disclosure provide an electric power machine. The electric power machine may include a power machine frame. The electric power machine may include a plurality of electric actuators supported by the power machine frame, where the plurality of electric actuators may include a set of electric lift actuators and a set of electric tilt actuators. The electric power machine may include a lift arm structure that may include: a lift arm coupled to the power machine frame and configured to be moved relative to the power machine frame by the set of electric lift actuators; and a work element supported by the lift arm and configured to be moved relative to the lift arm by the set of electric tilt actuators. The electric power machine may include an electrical power source configured to power the plurality of electric actuators. The electric power machine may include one or more electronic processors in communication with the plurality of electric actuators. The one or more electronic processors may be configured to: receive a command for movement of the lift arm using the set of electric lift actuators or movement of the work element using the set of electric tilt actuators; and control, based on the command, the set of electric lift actuators or the set of electric tilt actuators to, respectively, substantially balance forces between the set of electric lift actuators or substantially balance forces between the set of electric tilt actuators.

Some configurations described herein provide a method for controlling an electric power machine. The method may include receiving, with one or more electronic processors, a command to perform an operation with a plurality of electric actuators of the electric power machine, the plurality of electric actuators including a first electric actuator and a second electric actuator. The method may include controlling, with the one or more electronic processors, the first electric actuator based on a velocity control parameter to perform the operation. The method may include determining, with the one or more electronic processors, a target electric current for the second electric actuator based on a present electric current of the first electric actuator while the first electric actuator is controlled based on the velocity control parameter to perform the operation. The method may include controlling, with the one or more electronic processors, the second electric actuator based on the target electric current to perform the operation.

Some configurations described herein provide a method for controlling an electric power machine. The method may include receiving, with one or more electronic processors, a command for controlling a work element with a plurality of electric actuators of the electric power machine. The method may include determining, with the one or more electronic processors, a target velocity for the plurality of electric actuators based on the command. The method may include controlling, with the one or more electronic processors, the plurality of electric actuators based on the target velocity. The method may include, while controlling the plurality of electric actuators based on the target velocity, monitoring, with the one or more electronic processors, electric currents of a first electric actuator and a second electric actuator of the plurality of electric actuators to detect an electric current difference between the electric currents of the first electric actuator and the second electric actuator. The method may include, responsive to detecting the electric current difference: determining, with the one or more electronic processors, a first adjusted target velocity for the first electric actuator; and controlling, with the one or more electronic processors, the first electric actuator based on the first adjusted target velocity.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

BRIEF DESCRIPTION OF THE DRAWINGS

The following drawings are provided to help illustrate various features of examples of the disclosure and are not intended to limit the scope of the disclosure or exclude alternative implementations.

DETAILED DESCRIPTION OF THE PRESENT DISCLOSURE

Figure 1:
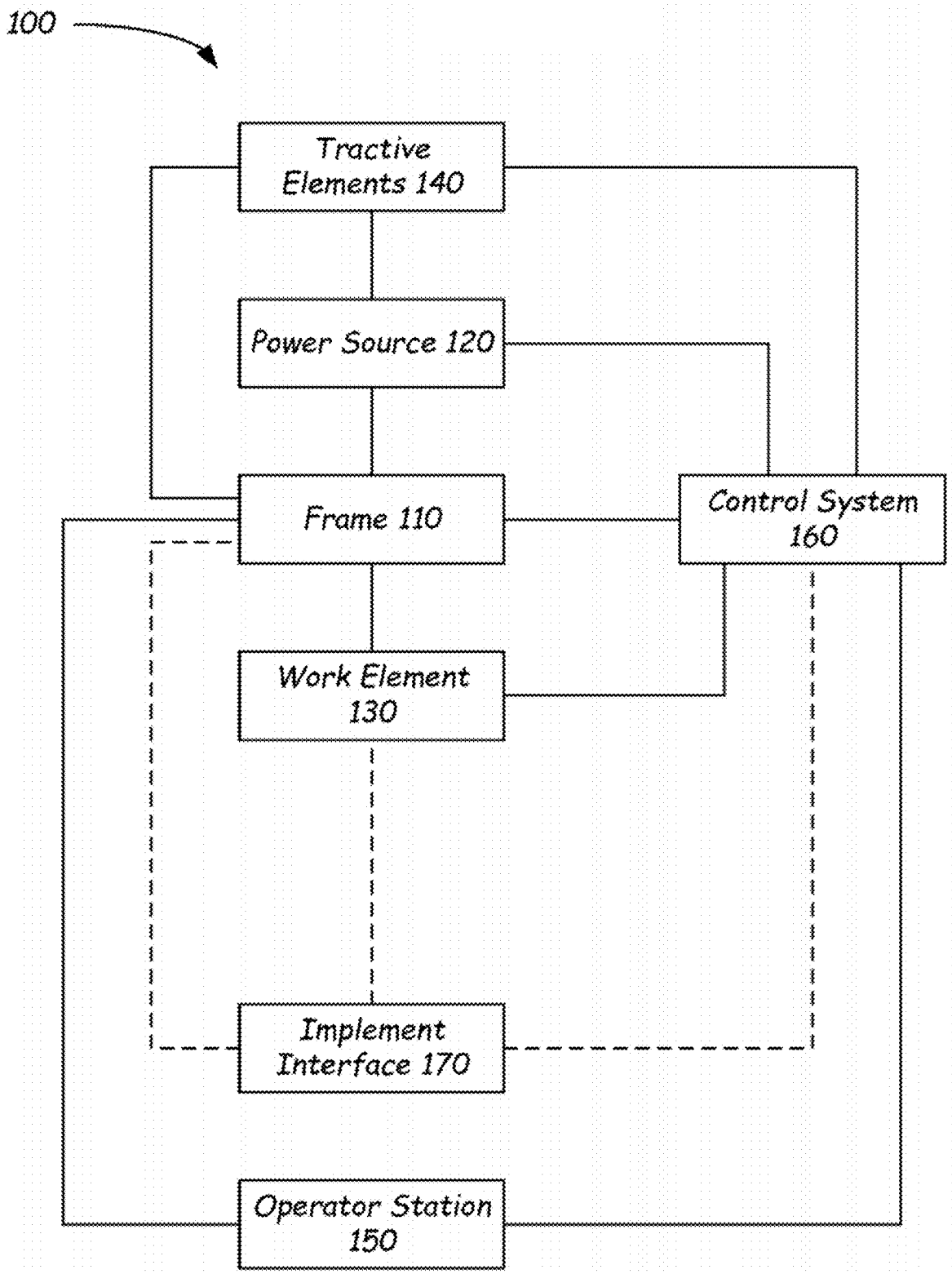
FIG. 1 is a block diagram illustrating functional systems of a representative power machine on which configurations of the present disclosure can be advantageously practiced.

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

While the power machines disclosed herein may be embodied in many different forms, several specific embodiments are discussed herein with the understanding that the embodiments described in the present disclosure are to be considered only exemplifications of the principles described herein, and the technology disclosed herein is not intended to be limited to the embodiments illustrated.

Some discussion below describes improved components and configurations for power machines, including components and configurations that use electrical (e.g., as opposed to hydraulic) power to operate certain power machine components or otherwise implement certain power machine functionality. In some configurations, electrically powered components can be mounted to a frame of a power machine to selectively move work elements of the power machine, including lift arms or implement carriers. In some configurations, electrically powered components can provide motive power for a power machine, including for tracked power machines (e.g., compact tracked loaders).

The technology disclosed herein relates to electric power machines, including automated operation of electric power machines. In particular, the technology disclosed herein relates to systems and methods of controlling sets of electric actuators of a power machine to provide improved force balancing. For example, implementations of the disclosed technology can be used to implement a force balancing control scheme or method that substantially balances forces between electric actuators that act on a common load. This can be particularly useful, for example, to mitigate premature wear (e.g., reduce maintenance, repairs, and downtime) experienced by one or more electric actuators of the paired electric actuators, as may tend to result from imbalanced forces on actuators under conventional control systems. Additionally, some configurations disclosed herein may also reduce (e.g., eliminate) underperformance conditions of the power machine, such as those underperformance conditions resulting from imbalanced forces between the paired electric actuators. As further detailed below, various control methods and system configurations can be used to facilitate automated force balancing for various types of work elements, including for electric actuators of electric power machines in particular.

Accordingly, some configurations of the disclosure are directed to implementing force balancing for power machines and, in particular, to provide force balancing such that a pair of electric actuators of electric power machines exert substantially balanced forces when acting on a common load. Configurations described herein facilitate automated force balancing for electric power machines. Accordingly, the technology disclosed herein may provide an advantageous control scheme that enables electric actuator force balancing on an electric power machine with paired electric actuators.

More specifically, power machines, such as skid-steers, compact track loaders, etc., may utilized sets of actuators that cooperatively provide force to perform a particular task, including lift operations. For example, pairs of actuators may be generally positioned opposite each other on a lift arm assembly, a work element, or other structure. The pairs of actuators may then cooperatively work together to synchronously perform an operation (e.g., a work task), such that each actuator synchronously acts on a common load. For example, the actuators may include a pair of lift actuators that cooperatively perform a lift operation by synchronously exerting a force on a lift arm assembly. As another example, the actuators may include a pair of tilt actuators that cooperatively perform a tilt operation by synchronously adjusting a tilt angle of a work element (e.g., a bucket or other implement).

As such, it may be useful to control sets of actuators for synchronized operation such that the actuators exert balanced forces on a common load (e.g., each actuator provides the same or substantially the same force on the common load). In some cases, hydraulic actuator systems can implement a position control scheme such that each actuator is controlled based on the same velocity (e.g., a commanded or controlled velocity). In hydraulic actuator systems, such a velocity control scheme may inherently maintain balanced forces between cooperating hydraulic actuators (e.g., sets of lift or tilt cylinders) because of the naturally self-correcting action of the hydraulic system.

In contrast, electric actuators are conventionally controlled based on position. However, when electric actuators are controlled to cooperatively perform an operation with respect to a common load, implementing a position control scheme may tend not to result in balanced forces between the actuators (as would be achieved by implementing that position control scheme with a hydraulic actuator system). This is because the precise position control of conventional motor controllers can conflict with the mechanical play and stacked tolerances of the structures of the power machine, with a result that a majority of force loading may tend to fall on only one actuator of a set (e.g., a lift actuator on only one side of a lift arm). In other words, implementing conventional position control for an electric actuator system may not facilitate force balancing between paired electric actuators because the common reference frame assumed by a conventional motor controller may not actually correspond to the real-world positioning and movement of the actuators on a power machine.

Accordingly, implementing a position control scheme in an electric actuator system generally results in unbalanced forces between paired electric actuators. In particular, when a position control scheme is utilized to control a pair of electric actuators, the electric actuators do not exert an equal force on the common load. Rather, one of the electric actuators generally exerts a majority of the force on the common load while the other electric actuator exerts little or no force on the common load. In some examples, the other electric actuator may thus even be pulled along a range of motion by the electric actuator that exerts the majority of the force on the common load, thus further accentuating the imbalanced loading between the actuators.

Such a force imbalance between the paired electric actuators may adversely impact the power machine. For example, the electric actuator that exerts the majority of the force, and that, ultimately, drags the other electric actuator, may experience premature wearing, which may ultimately result in increased maintenance, repairs, and downtime. As another example, the performance of the power machine may be hindered by the force imbalance, such that the power machine underperforms. Accordingly, when actuators cooperatively act on a common load, it can be advantageous to implement particular control schemes so that the forces exerted by the actuators to be substantially balanced.

In some examples, force balancing may be implemented by commanding matching electric currents for sets of electric actuators. For example, a first electric actuator may be controlled via a velocity control scheme and a second electric actuator may be controlled via an electric current control scheme, where the electric current of the second electric actuator may be controlled based on an electric current provided to the first electric actuator under the velocity control scheme. In other examples, electric currents of the set of electric actuators may be monitored for electric current differences. In such examples, when an electric current difference is detected, one or more of the electric actuators may be controlled via a velocity control scheme, where automatic velocity adjustments at one or more of the electric actuators (e.g., increasing or decreasing velocity for one or more of the electric actuators) can compensate for electric current differences between the actuators. In still other examples, the set of electric actuators may be controlled via an electric current control scheme, where the same commanded electric current may be used to affect control for each of the set of electric actuators.

Figure 2:
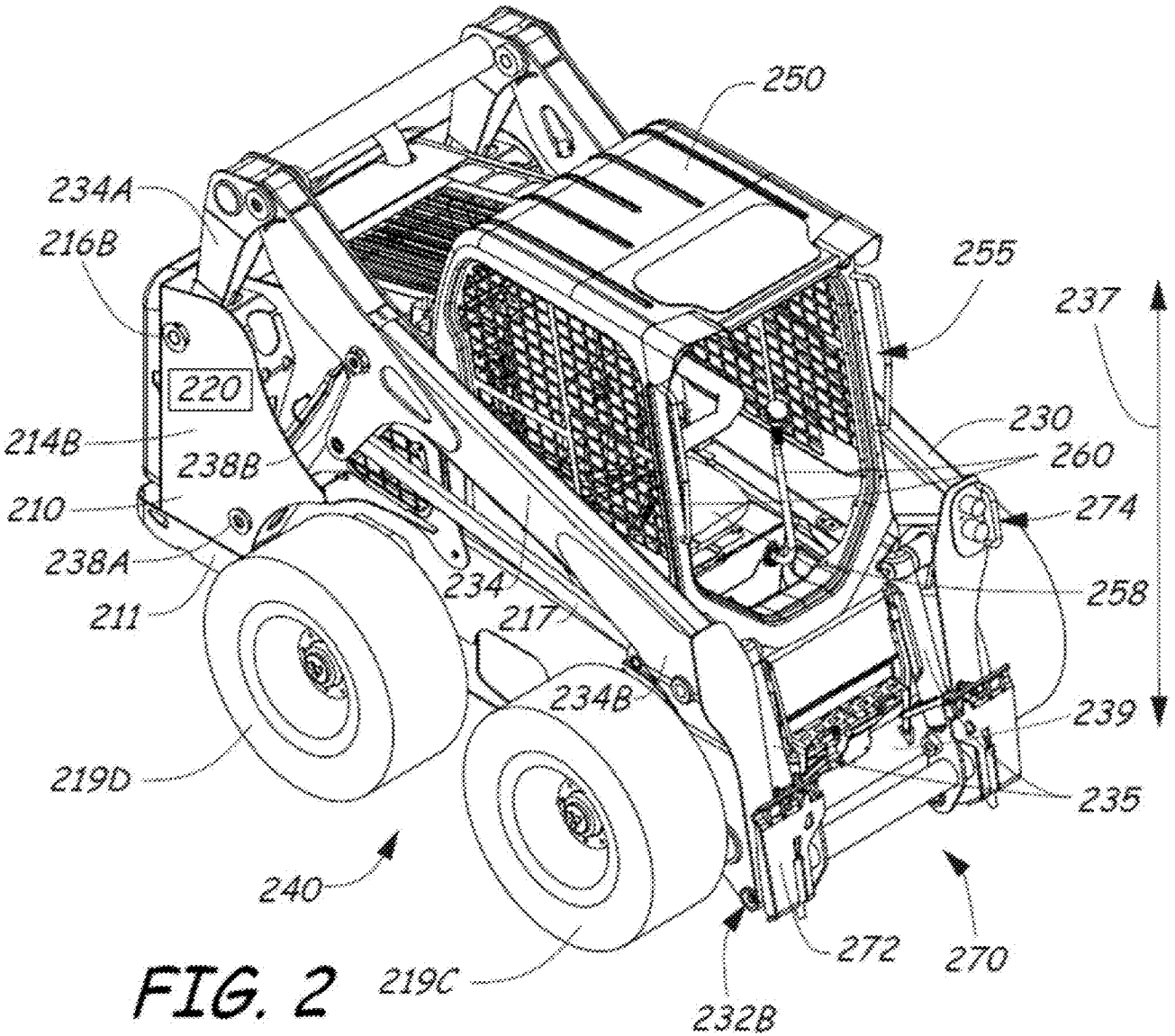
FIG. 2 is a perspective view showing generally a front of a power machine on which configurations disclosed in this specification can be advantageously practiced.
Figure 3:
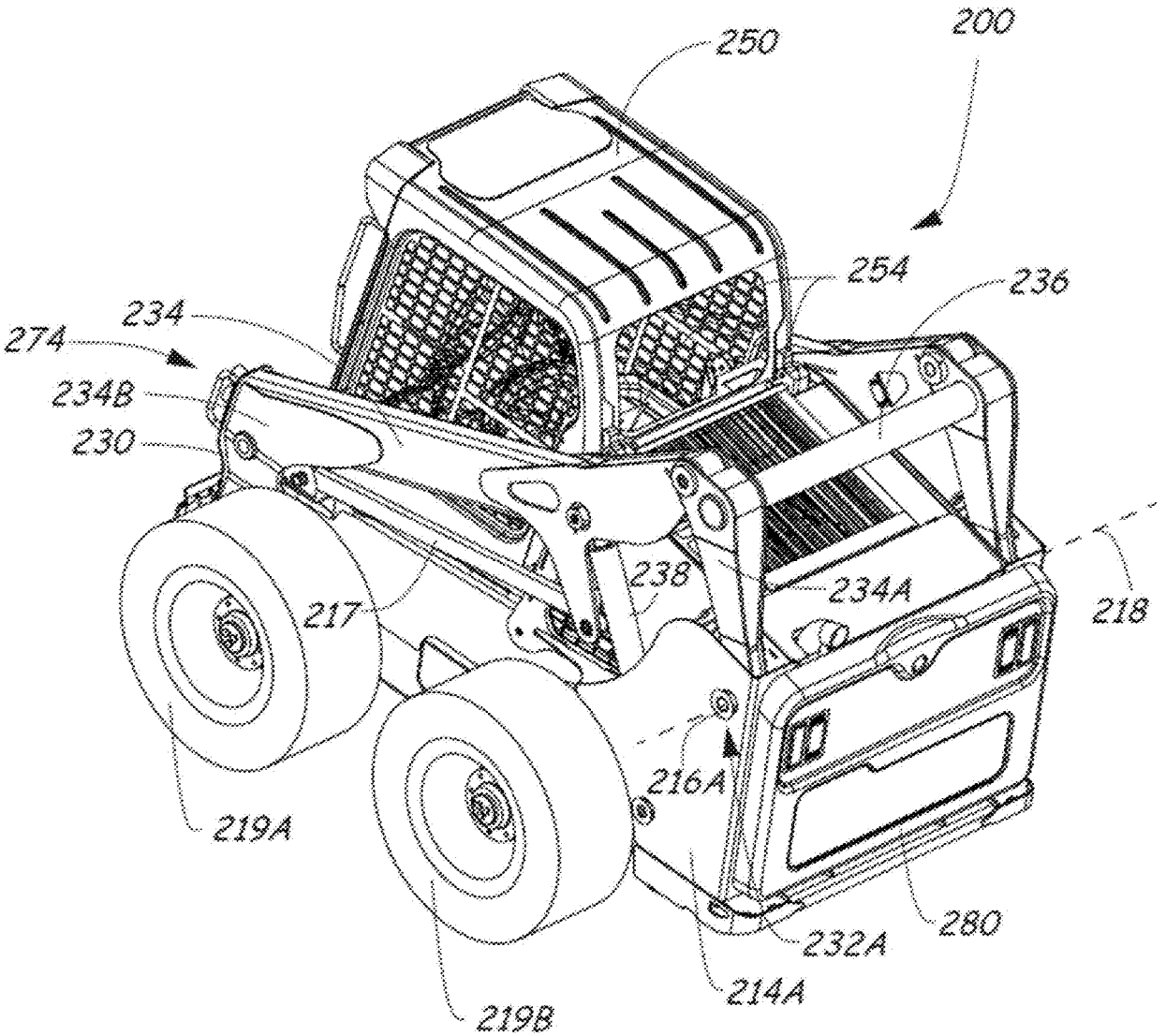
FIG. 3 is a perspective view showing generally a back of the power machine shown in FIG. 2.

These concepts can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is illustrated and discussed as being a representative power machine. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

FIG. 1 is a block diagram that illustrates the basic systems of a power machine 100, which can be any of a number of different types of power machines, upon which the embodiments discussed below can be advantageously incorporated. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, i.e., the lift arm can be manipulated to position the implement to perform the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of different implements to the work element. One characteristic of such an implement carrier is that once an implement is attached to it, it is fixed to the implement (i.e., not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements synchronously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which is configured to provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that is configured to convert the output from an engine into a form of power that is usable by a work element. Other types of power sources can be incorporated into power machines, including electric sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. For example, the power machine can be a mower with a mower deck or other mower component as a work element, which may be movable with respect to the frame of the mower. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e., from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e., remote from both of the power machine and any implement to which is it coupled) that is capable of controlling at least some of the operator-controlled functions on the power machine.

FIGS. 2-3 illustrate a loader 200, which is one particular example of a power machine of the type illustrated in FIG. 1 where the embodiments discussed below can be advantageously employed. Loader 200 is a skid-steer loader, which is a loader that has tractive elements (in this case, four wheels) that are mounted to the frame of the loader via rigid axles. Here the phrase "rigid axles" refers to the fact that the skid-steer loader 200 does not have any tractive elements that can be rotated or steered to help the loader accomplish a turn. Instead, a skid-steer loader has a drive system that independently powers one or more tractive elements on each side of the loader so that by providing differing tractive signals to each side, the machine will tend to skid over a support surface. These varying signals can even include powering tractive element(s) on one side of the loader to move the loader in a forward direction and powering tractive element(s) on another side of the loader to mode the loader in a reverse direction so that the loader will turn about a radius centered within the footprint of the loader itself. The term "skid-steer" has traditionally referred to loaders that have skid steering as described above with wheels as tractive elements. However, it should be noted that many track loaders also accomplish turns via skidding and are technically skid-steer loaders, even though they do not have wheels. For the purposes of this discussion, unless noted otherwise, the term skid-steer should not be seen as limiting the scope of the discussion to those loaders with wheels as tractive elements. Correspondingly, although some example power machines discussed herein are presented as skid-steer power machines, some embodiments disclosed herein can be implemented on a variety of other power machines. For example, some embodiments can be implemented on compact loaders or compact excavators that do not accomplish turns via skidding.

Loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. Skid-steer loader 200 is described herein to provide a reference for understanding one environment on which the embodiments described below related to track assemblies and mounting elements for mounting the track assemblies to a power machine may be practiced. The loader 200 should not be considered limiting especially as to the description of features that loader 200 may have described herein that are not essential to the disclosed embodiments and thus may or may not be included in power machines other than loader 200 upon which the embodiments disclosed below may be advantageously practiced. Unless specifically noted otherwise, embodiments disclosed below can be practiced on a variety of power machines, with the loader 200 being only one of those power machines. For example, some or all of the concepts discussed below can be practiced on many other types of work vehicles such as various other loaders, excavators, trenchers, and dozers, to name but a few examples.

Loader 200 includes frame 210 that supports a power system 220, the power system being capable of generating or otherwise providing power for operating various functions on the power machine. Power system 220 is shown in block diagram form but is located within the frame 210. Frame 210 also supports a work element in the form of a lift arm assembly 230 that is powered by the power system 220 and that can perform various work tasks. As loader 200 is a work vehicle, frame 210 also supports a traction system 240, which is also powered by power system 220 and can propel the power machine over a support surface. The lift arm assembly 230 in turn supports an implement interface 270, which includes an implement carrier 272 that can receive and secure various implements to the loader 200 for performing various work tasks and power couplers 274, to which an implement can be coupled for selectively providing power to an implement that might be connected to the loader. Power couplers 274 can provide sources of hydraulic or electric power or both. The loader 200 includes a cab 250 that defines an operator station 255 from which an operator can manipulate various control devices 260 to cause the power machine to perform various work functions. Cab 250 can be pivoted back about an axis that extends through mounts 254 to provide access to power system components as needed for maintenance and repair.

The operator station 255 includes an operator seat 258 and a plurality of operation input devices, including control levers 260 that an operator can manipulate to control various machine functions. Operator input devices can include buttons, switches, levers, sliders, pedals and the like that can be stand-alone devices such as hand operated levers or foot pedals or incorporated into hand grips or display panels, including programmable input devices. Actuation of operator input devices can generate signals in the form of electric signals, hydraulic signals, and/or mechanical signals. Signals generated in response to operator input devices are provided to various components on the power machine for controlling various functions on the power machine. Among the functions that are controlled via operator input devices on power machine 200 include control of the tractive elements 219, the lift arm assembly 230, the implement carrier 272, and providing signals to any implement that may be operably coupled to the implement.

Loaders can include human-machine interfaces including display devices that are provided in the cab 250 to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided. Other power machines, such walk behind loaders may not have a cab nor an operator compartment, nor a seat. The operator position on such loaders is generally defined relative to a position where an operator is best suited to manipulate operator input devices.

Various power machines that can include and/or interacting with the embodiments discussed herein can have various different frame components that support various work elements. The elements of frame 210 discussed herein are provided for illustrative purposes and frame 210 is not the only type of frame that a power machine on which the embodiments can be practiced can employ. Frame 210 of loader 200 includes an undercarriage or lower portion 211 of the frame and a mainframe or upper portion 212 of the frame that is supported by the undercarriage. The mainframe 212 of loader 200, in some embodiments is attached to the undercarriage 211 such as with fasteners or by welding the undercarriage to the mainframe. Alternatively, the mainframe and undercarriage can be integrally formed. Mainframe 212 includes a pair of upright portions 214A and 214B located on either side and toward the rear of the mainframe that support lift arm assembly 230 and to which the lift arm assembly 230 is pivotally attached. The lift arm assembly 230 is illustratively pinned to each of the upright portions 214A and 214B. The combination of mounting features on the upright portions 214A and 214B and the lift arm assembly 230 and mounting hardware (including pins used to pin the lift arm assembly to the mainframe 212) are collectively referred to as joints 216A and 216B (one is located on each of the upright portions 214) for the purposes of this discussion. Joints 216A and 216B are aligned along an axis 218 so that the lift arm assembly is capable of pivoting, as discussed below, with respect to the frame 210 about axis 218. Other power machines may not include upright portions on either side of the frame or may not have a lift arm assembly that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. Frame 210 also supports a pair of tractive elements in the form of wheels 219A-D on either side of the loader 200.

The lift arm assembly 230 shown in FIGS. 2-3 is one example of many different types of lift arm assemblies that can be attached to a power machine such as loader 200 or other power machines on which embodiments of the present discussion can be practiced. The lift arm assembly 230 is what is known as a vertical lift arm, meaning that the lift arm assembly 230 is moveable (i.e., the lift arm assembly can be raised and lowered) under control of the loader 200 with respect to the frame 210 along a lift path 237 that forms a generally vertical path along which the lift arm assembly can be raised or lowered. Other lift arm assemblies can have different geometries and can be coupled to the frame of a loader in various ways to provide lift paths that differ from the radial path of lift arm assembly 230. For example, some lift paths on other loaders provide a radial lift path. Other lift arm assemblies can have an extendable or telescoping portion. Other power machines can have a plurality of lift arm assemblies attached to their frames, with each lift arm assembly being independent of the other(s). Unless specifically stated otherwise, none of the inventive concepts set forth in this discussion are limited by the type or number of lift arm assemblies that are coupled to a particular power machine.

The lift arm assembly 230 has a pair of lift arms 234 that are disposed on opposing sides of the frame 210. A first end 232A of each of the lift arms 234 is pivotally coupled to the power machine at joints 216 and a second end 232B of each of the lift arms is positioned forward of the frame 210 when in a lowered position as shown in FIG. 2. Joints 216 are located toward a rear of the loader 200 so that the lift arms extend along the sides of the frame 210. The lift path 237 is defined by the path of travel of the second end 232B of the lift arms 234 as the lift arm assembly 230 is moved between a minimum and maximum height.

Each of the lift arms 234 has a first portion 234A of each lift arm 234 is pivotally coupled to the frame 210 at one of the joints 216 and the second portion 234B extends from its connection to the first portion 234A to the second end 232B of the lift arm assembly 230. The lift arms 234 are each coupled to a cross member 236 that is attached to the first portions 234A. Cross member 236 provides increased structural stability to the lift arm assembly 230. A pair of actuators 238, which on loader 200 are hydraulic cylinders configured to receive pressurized fluid from power system 220, are pivotally coupled to both the frame 210 and the lift arms 234 at pivotable joints 238A and 238B, respectively, on either side of the loader 200. The actuators 238 are sometimes referred to individually and collectively as lift cylinders. Actuation (i.e., extension and retraction) of the actuators 238 cause the lift arm assembly 230 to pivot about joints 216 and thereby be raised and lowered along a fixed path illustrated by arrow 237. Each of a pair of control links 217 are pivotally mounted to the frame 210 and one of the lift arms 232 on either side of the frame 210. The control links 217 help to define the fixed lift path of the lift arm assembly 230.

Some lift arms, most notably lift arms on excavators but also possible on loaders, may have portions that are controllable to pivot with respect to another segment instead of moving in concert (i.e., along a pre-determined path) as is the case in the lift arm assembly 230 shown in FIG. 2. Some power machines have lift arm assemblies with a single lift arm, such as is known in excavators or even some loaders and other power machines. Other power machines can have a plurality of lift arm assemblies, each being independent of the other(s).

An implement interface 270 is provided proximal to a second end 232B of the lift arm assembly 230. The implement interface 270 includes an implement carrier 272 that is capable of accepting and securing a variety of different implements to the lift arm 234. Such implements have a complementary machine interface that is configured to be engaged with the implement carrier 272. The implement carrier 272 is pivotally mounted at the second end 232B of the arm 234. Implement carrier actuators 235 are operably coupled the lift arm assembly 230 and the implement carrier 272 and are operable to rotate the implement carrier with respect to the lift arm assembly. Implement carrier actuators 235 are illustratively hydraulic cylinders and often known as tilt cylinders.

By having an implement carrier capable of being attached to a plurality of different implements, changing from one implement to another can be accomplished with relative ease. For example, machines with implement carriers can provide an actuator between the implement carrier and the lift arm assembly, so that removing or attaching an implement does not involve removing or attaching an actuator from the implement or removing or attaching the implement from the lift arm assembly. The implement carrier 272 provides a mounting structure for easily attaching an implement to the lift arm (or other portion of a power machine) that a lift arm assembly without an implement carrier does not have.

Some power machines can have implements or implement like devices attached to it such as by being pinned to a lift arm with a tilt actuator also coupled directly to the implement or implement type structure. A common example of such an implement that is rotatably pinned to a lift arm is a bucket, with one or more tilt cylinders being attached to a bracket that is fixed directly onto the bucket such as by welding or with fasteners. Such a power machine does not have an implement carrier, but rather has a direct connection between a lift arm and an implement.

The implement interface 270 also includes power coupler (s) 274 available for connection to an implement on the lift arm assembly 230. The power coupler(s) 274 includes pressurized hydraulic fluid port to which an implement can be removably coupled. The pressurized hydraulic fluid port selectively provides pressurized hydraulic fluid for powering one or more functions or actuators on an implement. The power coupler can also include an electric power source for powering electric actuators and/or an electronic controller on an implement. The power coupler(s) 274 also exemplarily includes electric conduits that are in communication with a data bus on the excavator 200 to allow communication between a controller on an implement and electronic devices on the loader 200.

Frame 210 supports and generally encloses the power system 220 so that the various components of the power system 220 are not visible in FIGS. 2-3. The arrangement of drive pumps, motors, and axles in power machine 200 is but one example of an arrangement of these components. As discussed above, power machine 200 is a skid-steer loader and thus tractive elements on each side of the power machine are controlled together via the output of a single hydraulic pump, either through a single drive motor as in power machine 200 or with individual drive motors. Various other configurations and combinations of hydraulic drive pumps and motors can be employed as may be advantageous.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Figure 4:
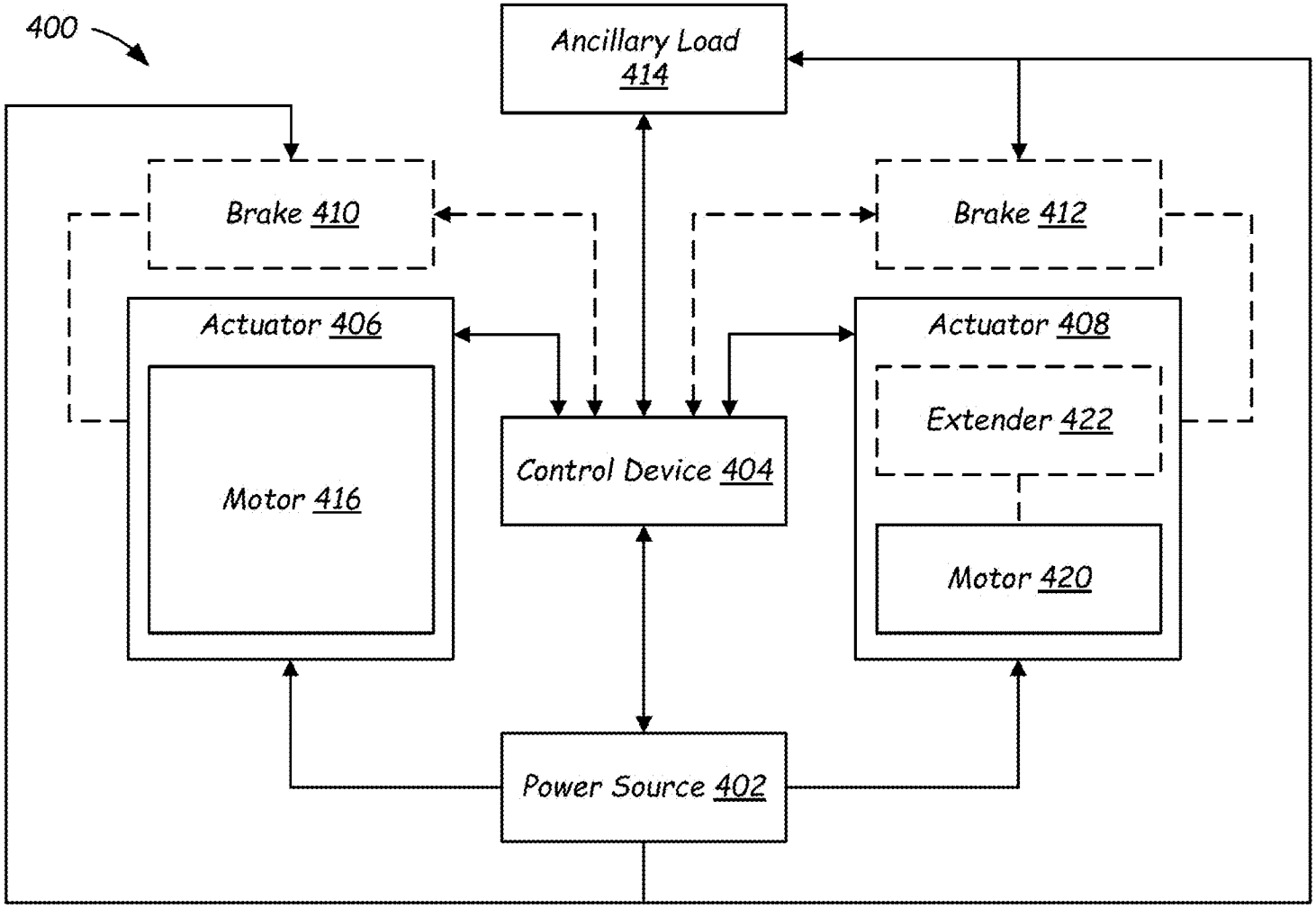
FIG. 4 is a block diagram illustrating components of a power system of the loader of FIGS. 2 and 3 or other power machines.

FIG. 4 shows a schematic illustration of a block diagram of a power machine 400, which can be any of a number of different types of power machines (e.g., wheeled or tracked skid-steer loaders), including any of the types generally discussed above. To accomplish various work and drive operations, the power machine 400 can include a power source 402, a control device 404, and electric actuators 406, 408. Either or both of the electric actuators 406, 408 can be variously configured as one or more drive actuators, or one or more workgroup actuators, and a different number of individual actuators can be provided than is generally shown in FIG. 4. For example, as further discussed below, some power machines can include a left-side and right-side drive actuators, each including a respective electronic drive motor disposed to power an associate tractive element (e.g., an endless track assembly), as well as various extendable (or other) work actuators (e.g., one or more extendable lift arm actuators, one or more extendable tilt actuators, etc.). In some cases, as also shown in FIG. 4, one or more brakes 410, 412 can be configured to stop movement of an associated one or more of the actuators 406, 408, including based on control signals from the control device 404. While one or more brakes 410, 412 are shown in FIG. 4 as being distinct from the actuator 106, 408, respectively, the brakes in at least some embodiments consistent with the present disclosure may be integrated in the actuators themselves.

In the illustrated example, the power machine 400 can be an electrically powered power machine and thus the power source 402 can include an electric power source such as, for example, a battery pack that includes one or more battery cells (e.g., lithium-ion batteries). In some embodiments, the power source 402 can include other electric storage devices (e.g., a capacitor), and other power sources. In addition, the power machine 400 can, but need not, include an internal combustion engine that provides, via a generator, electric power to the power source 402 (e.g., to charge one or more batteries of the electric power source).

Generally, the control device 404 can be implemented in a variety of different ways and can include one or more types or instances of known electronic controllers. For example, the control device 404 can be implemented as known types of processor devices, (e.g., microcontrollers, field-programmable gate arrays, programmable logic controllers, logic gates, etc.), including as part of one or more general or special purpose computers. In addition, the control device 404 can also include or be in operative communication with other computing components, including memory, inputs, output devices, etc. (not shown). In this regard, the control device 404 can be configured to implement some or all of the operations of the processes described herein, which can, as appropriate, be retrieved from or otherwise interact with memory. In some embodiments, the control device 404 can include multiple control devices (or modules) that can be integrated into a single component or arranged as multiple separate components. In some embodiments, the control device 404 can be part of a larger control system (e.g., the control system 160 of FIG. 1) and can accordingly include or be in electronic communication with a variety of control modules, including hub controllers, engine controllers, drive controllers, and so on.

In different embodiments, different types of actuators can be configured to operate under power from the power source 402, including electric actuators configured as rotary actuators, linear actuators, and combinations thereof. In the example shown in FIG. 4, the actuator 406 is a drive actuator and includes an electric motor 416 that is configured to provide rotational power to one or more tractive elements (not shown in FIG. 4). As noted above, some power machines can include multiple drive actuators, including as can be arranged for skid-steer operation.

Also as shown in the example of FIG. 4, the actuator 408 is a workgroup actuator and thus includes an electric motor 420 that is configured to provide rotational power for operation of one or more non-drive work elements (e.g., a lift arm, an implement, etc.). In some cases, the motor 420 can be configured to power movement of an extender 422 (e.g., a lead screw, a ball screw, another similar threaded assembly, or other known components for rotationally powered non-rotational movement), which can convert rotational power of the motor 420 into translational movement of the extender 422 so as to provide translational power to a work element of the power machine 400. For example, the motor 420 can rotate in a first direction to drive extension of the extender 422 and can rotate in a second direction to drive retraction of the extender 422 when the motor rotates in a second rotational direction opposite the first rotational direction. In this way, and depending on how the electric actuator 406 is coupled to the components of the power machine 400, extension (and retraction) of the electric actuator 406 can, for example, raise (or lower) a lift arm of the power machine 400, change an attitude an implement of the power machine 400 (e.g., a bucket), etc.

Thus, generally, each motor 416, 420 can be controlled to implement particular functionality for the power machine 400. As generally noted above, different configurations of multiple drive or workgroup actuators can be included in some cases (e.g., multiple instances of the actuators 406, 408 as shown), to provide different functionality for a particular power machine. For example, in some configurations, the power machine 400 can include an electric actuator that is a first lift actuator on a first lateral side of the power machine 400, an electric actuator that is a second lift actuator on a second lateral side of the power machine 400, an electric actuator that is a first tilt actuator that is on a first lateral side of the implement interface of the power machine 400, an electric actuator that is a second tilt actuator that is on a second lateral side of the implement interface of the power machine 400, an electric actuator that is a first drive actuator for a first drive system that is on (or otherwise powers one or more tractive elements for) the first lateral side of the power machine 400, and an electric actuator that is a second drive actuator for a second drive system that is on (or otherwise powers one or more tractive elements for) the second lateral side of the power machine 400.

As also noted above, the brakes 410, 412 can be coupled to (e.g., included in) the respective electric actuators 406, 408 in some embodiments. In this regard, a wide variety of known brake systems can be used. For example, one or more brakes can be a mechanical brake that includes a mechanical stop that can be moved into engagement to block movement of a relevant extender or relevant motor, in one or more directions, and can be moved out of engagement to allow movement of the relevant extender or motor. In some cases, a mechanical brake can include an arm that contacts a lead screw of an extender to block further movement of the lead screw. In some embodiments, one or more electrically powered brakes can be provided (i.e., brake assemblies that include one or more electric actuators for application of braking force).

As shown in FIG. 4, the power source 402 can be electrically connected to the control device 404, the electric actuators 406, 408, and the brakes 410, 412 (as appropriate), as well as one or more ancillary loads 414. Thus, the power source 402 can provide power to each motor 416, 420 to drive movement (e.g., extension and retraction) of the respective extenders 418, 422, to the control device 404, to each brake 410, 412 (as appropriate), to each of the ancillary load(s) 414, etc. Further, the power source 402 can provide power to the ancillary loads 414 (i.e., loads not associated with providing tractive or workgroup power) for various ancillary functionality. For example, ancillary loads 414 can include a climate control system (e.g., including a heater, an air-conditioning system, a fan, etc.), a sound system (e.g., a speaker, a radio, etc.), etc. In some cases, ancillary loads 414 may be treated with lower priority according to certain power management modes.

As shown in FIG. 4, the control device 404 can be in electrical communication with the power source 402, the actuators 406, 408, the brakes 410, 412 (as appropriate), and the ancillary load(s) 414, and can adjust (e.g., limit) the power delivered from the power source 402 to, or the power consumed by, each of these electric loads (or others). For example, as appropriate, the control device 404 can adjust (e.g., decrease) the power delivered to each of these electric loads by adjusting (e.g., decreasing) the electric current that can be consumed by at least some of these electric loads. In some cases, the control device 404 can adjust the electric current delivered to an electric load by adjusting a driving signal delivered to an electric current source (e.g., a voltage controlled electric current source) that can be electrically connected to the electric load (e.g., integrated within a power electronics driver board, such as a motor driver) to deliver electric current to the electric load. For example, the electric current source can include one or more field-effect transistors, and the driving signal can be the voltage applied to the one or more field-effect transistors to adjust the electric current delivered and thus the power delivered to the electric load (e.g., the motor).

In some embodiments, similarly to each of the electric loads of the power machine 400, the electric power source of the power source 402 can include (or can be otherwise electrically connected to) an electric current source (e.g., a power electronics board) that adjusts (e.g., and can restrict) the amount of power to be delivered to the electric loads of the power machine 400. In this case, the control device 404 can adjust the driving signal to the electric power source to adjust the total amount of electric current and thus the amount of power delivered to the electric loads of the power machine 400. For example, the control device 404 can adjust the output from the electric power source 402 to regulate the torque, position, direction, and speed of one or more motors powered by the power source 402.

In some embodiments, the control device 404 can be configured to determine a present (i.e., temporally current) power usage of one or more actuators or other electric loads, or a present power delivery from a power source. In some cases, a present power usage or delivery can be measured instantaneously. In some cases, a present power usage or delivery can be measured as an average power delivery over a recent time interval (e.g., a preceding 2 seconds). Thus, for example, the control device 404 can determine a present power usage for each electric load of the power machine 400, or can determine a present power delivery from the electric power source of the power source 402.

In some cases, each electric load of the power machine 400, and the power source 402 can include or can otherwise be electrically connected to an electric current sensor to determine the electric current being provided to (or by) the particular electric component, and a voltage being provided to (or by) the particular electric component can also be determined (e.g., based on voltage sensor or a fixed voltage provided by the power source 402). In this way, for example, the control device 404 can receive information about a present voltage and a present electric current that is delivered to each individual electric load, or about the present voltage and electric current that is supplied by the electric power source of the power machine 400 in total and can thereby determine a present power usage for relevant (e.g., all) electric loads and for the electric power source of the power machine 400.

In some embodiments, the control device 404 can determine a present power usage for the electric power source of the power machine 400 by adding the present power usage for each relevant electric load of the power machine 400 (e.g., as determined by multiplying electric current and voltage for the loads). Alternatively, for example, power can be determined by multiplying the torque and speed of one or more relevant motors. In certain circumstances, it may be advantageous to use either of these known methods. In other cases, the control device 404 can determine a present power usage of the electric power source of the power machine 400 only by determining the power delivered by the electric power source. For example, the control device 404 can receive a present value for electric current delivered by the electric power source 402 and, based on the voltage of the electric power source 402, can then determine a total present power usage for the electric power source. In some cases, the control device 404 can assume a substantially constant voltage for the electric power source and can then determine the present power usage of the electric power source by using the constant voltage and the present electric current value.

In some embodiments, the electric power source 402 can include or can be electrically connected to a sensor to sense a present remaining energy of the electric power source. In some cases, for example, a voltage sensor can sense the voltage of the electric power source, which can be indicative of the present remaining energy left within the electric power source (e.g., because the voltage of the electric power source can be related to the present remaining energy within the electric power source). Any suitable means for sensing the remaining energy of the electric power source can be used, including an accounting of how much electric current is supplied by the energy storage device over time.

Figure 5:
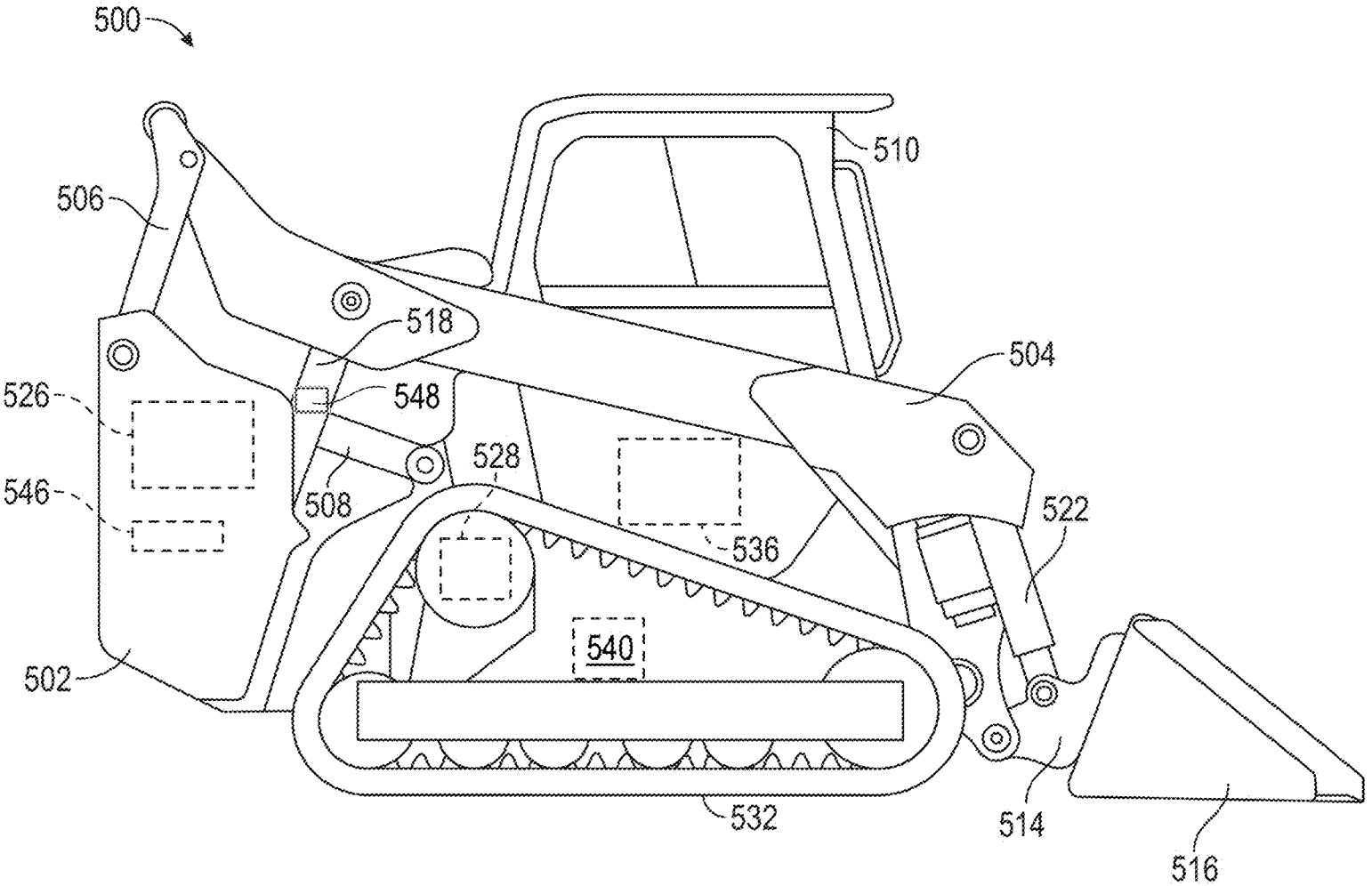
FIG. 5 is a side elevation view showing certain components of a power machine in the form of an electrically powered compact tracked loader according to configurations of the disclosure.

In some embodiments, the power machine 400 can include one or more sensors that can sense various aspects of the power machine 400. For example, the power machine 400 can include a torque sensor for one or more electric actuators, to sense a present torque of the one or more electric actuator. In some cases, the torque sensor can be the same as the electric current sensor electrically connected to the electric actuator (e.g., because electric current is related to the torque). As another example, the power machine 400 can include a position sensor for one or more extenders or other components of one or more electric actuators (as appropriate), including as may sense a present extension amount for an extender of an electric actuator (e.g., relative to the housing of the electric actuator). In some cases, this can be a hall-effect sensor, a rotary encoder for the motor (e.g., which can be used to determine the extension amount of actuators with extenders), an optical sensor, etc. In some cases, as shown in FIG. 5, the power machine 400 can include a resolver 548 configured to track relative movement of the actuator 518. As yet another example, the power machine 400 can include an angle sensor for one or more pivotable joints (e.g., of the lift arm) to determine a current orientation of the lift arm (and any implement coupled thereto). As yet another example, the power machine 400 can include a speed sensor or an acceleration sensor (e.g., an accelerometer) to respectively determine a current speed or a current acceleration of the entire power machine 400 or of a component thereof. As still yet another example, the power machine 400 can include an inclinometer (e.g., an accelerometer) that can sense the current attitude of a mainframe of the power machine 400 with respect to gravity.

FIG. 5 shows a side isometric view of an electrically powered power machine 500 with a lift arm in a fully lowered position, which can be a specific implementation of the power machine 200, the power machine 400, etc. As shown in FIG. 5, the power machine 500 can include a main frame 502, a lift arm 504 coupled to the main frame via a follower link 506, a driver link 508 pivotally coupled to the lift arm 504 and the main frame 502, an operator enclosure 510 (e.g., a cab, as shown), an implement interface 514 coupled to an end of the lift arm 504, an implement 516 (e.g., a bucket as shown) coupled to the implement interface 514, an electric lift actuator 518, an electric tilt actuators 522, an electric power source 526, a drive system 528 (e.g., including an electric drive motor), a traction devices 532 (e.g., an endless track, as shown), and a climate control system 536 (e.g., as generally representative of an ancillary electric load). In some embodiments, a suspension system 540 (e.g., a torsional suspension system) can be included, to provide improved ride control and overall smoothness of travel. As generally noted above, similar (e.g., substantially identical) other components can be provided symmetrically (or otherwise) on an opposing lateral side of the power machine 500 in some cases, including another electric lift actuator, another electric tilt actuator, etc.

In some cases, the electric power source 526 can be implemented in a similar manner as the previously described power sources (e.g., the power source 402). Thus, the electric power source 526 can include a battery pack including one or more batteries. In general, the electric power source 526 can supply power to some or all of the electric loads of the power machine 500. For example, the electric power source 526 can provide power to the lift electric actuator 518, the electric tilt actuator 522, the drive system 528, the climate control system 536, etc.

The power machine 500 can also include a control device 546 (e.g., a general or special purpose electronic computer or other electronic controller) that can be in communication with the power source 526 and some (or all) of the electric loads of the power machine 500, as appropriate. For example, the control device 546 can be in communication with the lift electric actuator 518, the electric tilt actuator 522, the drive system 528, the climate control system 536, etc. In this way, the control device 546 can control operation of these components, or related other systems, to adjust how power is routed to each of these electric loads (e.g., depending on the criteria defined by a particular power management mode) and, correspondingly, how these components operate under power from the power source 526.

Figure 6:
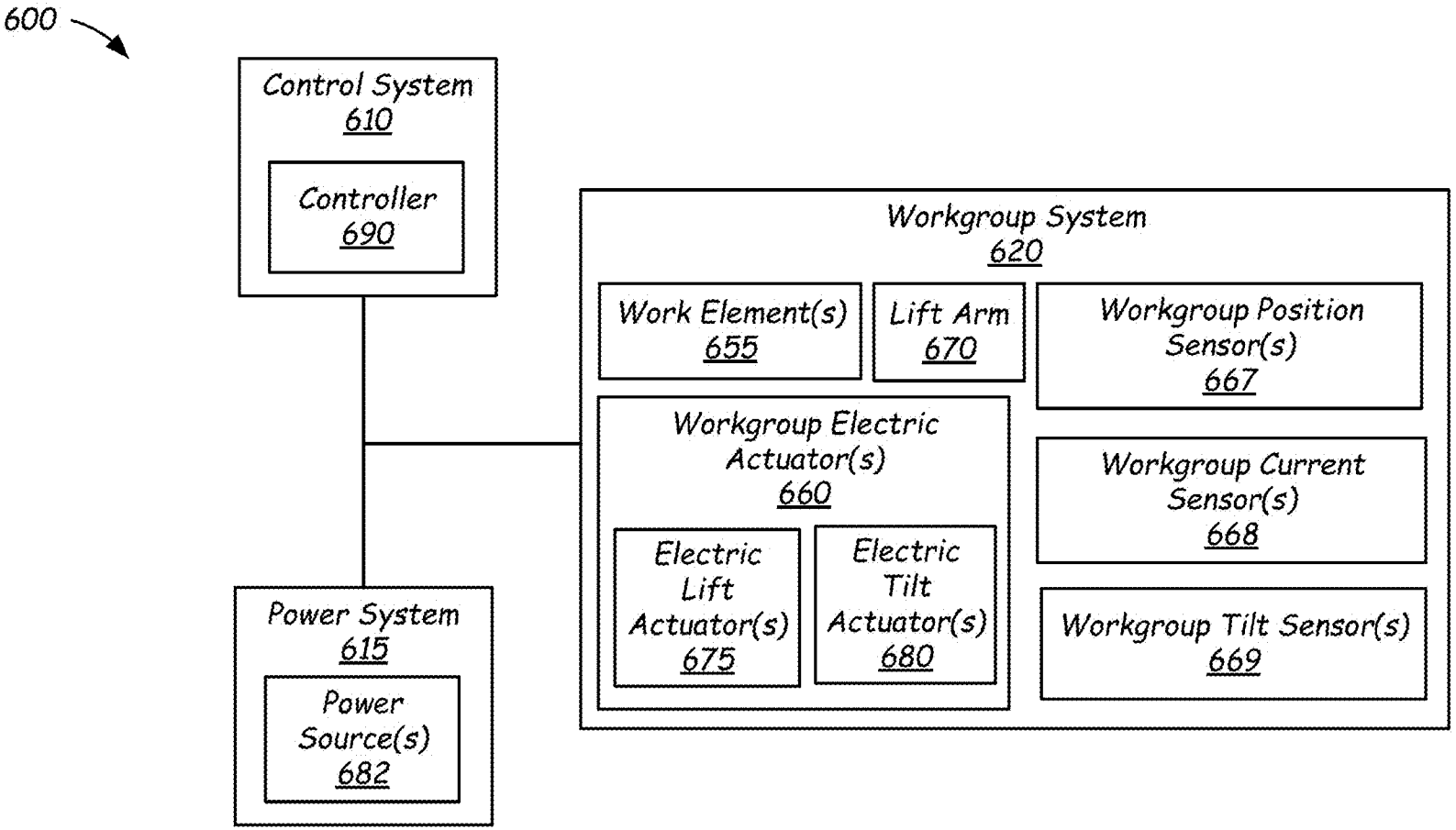
FIG. 6 is a block diagram of a power machine according to some configurations.

FIG. 6 schematically illustrates a power machine 600 according to some configurations. In the example illustrated in FIG. 6, the power machine 600 includes a control system 610 (e.g., the control system 160, as described herein), a power system 615, and a workgroup system 620. The control system 610, the power system 615, and the workgroup system 620 communicate over one or more communication lines or buses. The power machine 600 may include additional, fewer, or different components than those illustrated in FIG. 6 in various configurations and may perform additional functionality than the functionality described herein. For example, the power machine 600 may include additional, similar, or different components, systems, and functionality as described above with respect to the power machine 100 of FIG. 1, the loader 200 of FIGS. 2-3, the power machine 400 of FIG. 4, the electric power machine 500 of FIG. 5, or another power machine described herein.

As illustrated in FIG. 6, the power machine 600 includes the workgroup system 620, which can in some cases be a lift arm structure (as further discussed in examples below). In the illustrated example, the workgroup system 620 may include one or more work elements 655 (e.g., the work element 130 of FIG. 1, the bucket implement 516 of FIG. 5, or another attached implement), one or more workgroup electric actuators 660, one or more workgroup position sensors 667 (e.g., including one or more workgroup tilt sensors 669), one or more workgroup electric current sensors 668, and a lift arm 670 (e.g., the lift arm assembly 230 or a component thereof, as described herein).

In the illustrated example, the workgroup electric actuators 660 of the workgroup system 620 include an electric lift actuator 675 and an electric tilt actuator 680 (e.g., an electric lift actuator and an electric tilt actuator, respectively). Generally, lift and tilt actuators corresponding to the electric lift actuator 675 and the electric tilt actuator 680 are described in greater detail herein with respect to FIGS. 1-5.

In some configurations, the workgroup electric actuators 660 may include a pair of workgroup electric actuators 660. A pair of workgroup electric actuators 660 may include two or more workgroup electric actuators 660 (e.g., a first workgroup electric actuator, a second workgroup electric actuator, a third workgroup electric actuator, etc.). For example, the pair of workgroup electric actuators 660 may include a pair of electric tilt actuators 680 (e.g., a first electric tilt actuator, a second electric tilt actuator, a third electric tilt actuator, etc.), a pair of electric lift actuators 675 (e.g., a first electric lift actuator, a second electric lift actuator, a third electric lift actuator, etc.). A pair of workgroup electric actuators 660 may be controlled to cooperatively perform an operation or work task. For example, when the pair of workgroup electric actuators 660 includes a first electric lift actuator and a second electric lift actuator, the first and second electric lift actuators may be controlled to cooperatively perform a lift operation, such as, e.g., increasing or decreasing a position of the lift arm 670. As another example, when the pair of workgroup electric actuators 660 includes a first electric tilt actuator and a second electric tilt actuator, the first and second electric tilt actuators may be controlled to cooperatively perform a tilt operation, such as, e.g., adjusting a tilt angle between the work element 655 and the lift arm 670.

The workgroup position sensors 667 can be configured to measure a linear extension or angular orientation of an actuator or other component of a workgroup, with the work group tilt sensor 669 in particular arranged to measure a degree of tilt between the work element 655 and the lift arm 670 (although other tilt measurements are possible). The workgroup electric current sensors 668 can be configured to measure the electric current being provided to one or more of the workgroup electric actuator(s) 660. In some cases, a torque sensor can be used as the workgroup electric current sensor 668 (e.g., because electric current is related to the torque). In some examples, one or more of the workgroup position sensors 667 or the workgroup electric current sensors 668 can be integrated into one or more of the workgroup electric actuators 660 (e.g., can be included as part of the electric tilt or lift actuators 675, 680).

The workgroup electric current sensor(s) 668 may collect information about a present electric current that is delivered to the workgroup electric actuator(s) 660. The workgroup position sensor(s) 667 may collect position data for the power machine 600 (or a component thereof). As one example, the workgroup position sensor 667 may be associated with one of the workgroup electric actuators 660, and may detect position data for the associated workgroup electric actuator 660. For example, the workgroup position sensors 667 may measure or otherwise indicate rotational position data for an electric servo motor. As another example, the workgroup position sensors 667 may be associated with extenders of the workgroup electric actuators 660 (e.g., ball screws or other motor-driven extenders). Accordingly, in some configurations, the workgroup position sensors 667 may sense a current extension amount (as position data) for the extender of each workgroup electric actuator 660 (e.g., an extension distance relative to a housing of the workgroup electric actuator 660). In some cases, the workgroup position sensor 667 may be a hall-effect sensor, a rotary encoder for the motor (e.g., which can be used to determine the extension amount of actuators with extenders), an optical sensor, etc. Accordingly, in some configurations, position data may include a lift height of the lift arm 670 or the work element 655, an extension amount associated with the electric lift actuator 675, or the like.

As a specific implementation of a position sensor, the workgroup tilt sensor(s) 669 may collect tilt or orientation data for the power machine 600 (or a component thereof). In some configurations, the workgroup tilt sensor 669 may be an angle sensor for each pivotable join of the lift arm 670 of the power machine 600 to determine a current orientation of the lift arm 670 (or the work element(s) 655 coupled thereto). In some configurations, the workgroup tilt sensor 669 may determine a current attitude of a work element 655 relative to the lift arm 670 (e.g., a degree of tilt of an attached bucket or other implement) (as position data).

The power machine 600 may also include the power system 615 (e.g., the power system 120 of FIG. 1, the power system 220 of FIG. 2, etc.). In the illustrated example of FIG. 6, the power system 615 may include one or more power sources 682. As described herein, the power system 615 (via one or more of the power sources 682) may generate or otherwise provide electric power for operating various functions on the power machine 600 (or components thereof). The power system 615 may provide electric power to various components of the power machine 600, such as, e.g., one or more components of the control system 610, the workgroup system 620, or the like. Accordingly, the power machine 600 can be an electrically powered power machine and, thus, the power source(s) 682 of the power system 615 can include electric power sources, such as, e.g., a battery pack that includes one or more battery cells (e.g., lithium-ion batteries). In some configurations, the power system 615 can include other electric storage devices (e.g., a capacitor), and other power sources. Alternatively, or in addition, the power machine 600 can, but need not, include an internal combustion engine that provides, via a generator, electrically power to the power sources 682 (e.g., to charge one or more batteries of the electric power system 615).

The power machine 600 may also include the control system 610. The control system 610 (e.g., the control system 160 of FIG. 1) is configured to receive operator input or other input signals (e.g., sensor data, such as speed data, electric current data, position data, tilt or orientation data, or a combination thereof) and to output commands accordingly to control operation of the power machine 600. For example, the control system 610 can communicate with other systems of the power machine 600 to perform various work tasks, including to control the workgroup electric actuator(s) 660 for performing a work task operation (e.g., a digging operation, a roading operation, etc.), another operation of the power machine 600, or a combination thereof.

In some configurations, the control system 610 receives input from an operator input device, such as one of the operator input devices 262 of FIG. 2, including input as command signals provided by an operator of the power machine 405 via the operator input device 262 (also referred to herein as operator commands). As one example, an operator command or command signal may include a commanded lift for the workgroup system 620 of the power machine 600 (e.g., a change in lift of the work element at which the operator of the power machine 600 requests or commands). In response to receiving the input, the control system 610 may control the power machine 600 to perform the requested operation or otherwise maneuver based at least in part on the input received from the operator input device, the sensed operation data, or a combination thereof. Accordingly, in some configurations, the control system 610 may receive an input parameter corresponding to an operator command or input associated with operating the power machine 600, sensed operation data associated with the power machine 600, or a combination thereof.

Figure 7:
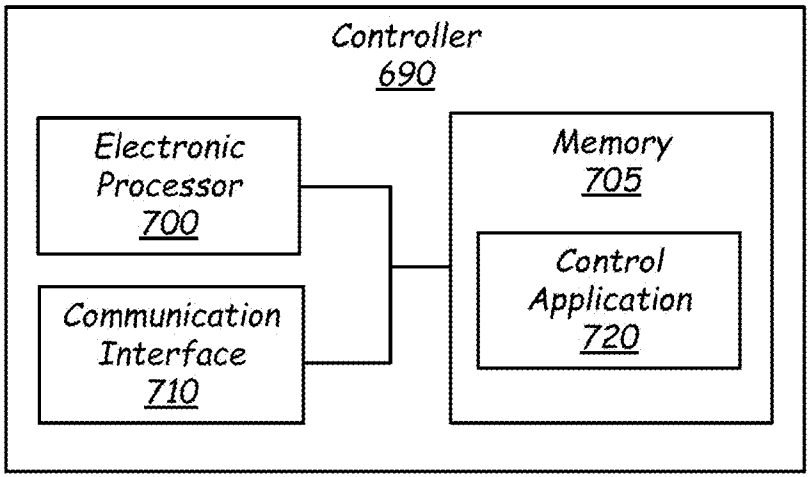
FIG. 7 schematically illustrates a controller of the power machine of FIG. 6 according to some configurations.

As illustrated in FIG. 6, the control system 610 includes a controller 690 (e.g., the control device(s) 260, 404 as described herein). FIG. 7 illustrates the controller 690 according to some configurations. In the illustrated example of FIG. 7, the controller 690 includes an electronic processor 700 (for example, a microprocessor, an application-specific integrated circuit ("ASIC"), or another suitable electronic device), a memory 705 (for example, a non-transitory, computer-readable medium), and a communication interface 710. The electronic processor 700, the memory 705, and the communication interface 710 communicate over one or more communication lines or buses. The controller 690 may include additional components than those illustrated in FIG. 7 in various configurations and may perform additional functionality than the functionality described herein. As one example, in some embodiments, the functionality described herein as being performed by the controller 690 may be distributed among other components or devices (e.g., one or more electronic processors).

The communication interface 710 allows the controller 690 to communicate with devices external to the controller 690. For example, as illustrated in FIG. 6, the controller 690 may communicate with the workgroup system 620 (or component(s) therein), other components or systems of the power machine 600, or a combination thereof through the communication interface 710.

The communication interface 710 may include a port for receiving a wired connection to an external device (for example, a universal serial bus ("USB") cabled and the like), a transceiver for establishing a wireless connection to an external device (for example, over one or more communication networks, such as the Internet, local area network ("LAN"), a wide area network ("WAN"), and the like), or a combination thereof. In some configurations, the controller 690 can be a dedicated or stand-alone controller. In some configurations, the controller 690 can be part of a system of multiple distinct controllers (e.g., a hub controller, a drive controller, a workgroup controller, etc.) or can be formed by a system of multiple distinct controllers (e.g., also with hub, drive, and workgroup controllers, etc.).

The electronic processor 700 is configured to access and execute computer-readable instructions ("software") stored in the memory 705. The software may include firmware, one or more applications, program data, filters, rules, one or more program modules, and other executable instructions. For example, the software may include instructions and associated data for performing a set of functions, including the methods described herein.

For example, as illustrated in FIG. 7, the memory 705 may include a control application 720 (referred to herein as "the application 720"). The application 720 may be a software application executable by the electronic processor 700 in the example illustrated and as specifically discussed below, although a similarly purposed module may be implemented in other ways in other examples. The application 720 may implement a control loop for controlling one or more of the workgroup electric actuators 660 using a control scheme, including one or more control parameters. For example, the application 720 (when executed by the electronic processor 700) may facilitate force balancing between sets of electric actuators (e.g., a pair of workgroup electric actuators 660), as described in greater detail herein.

A control parameter may be a parameter or value that may affect control of the power machine 600 (or a component thereof). For instance, a control parameter may be implemented as a command issued to a component of the power machine 600 such that, upon receipt of that command, operation of the component of the power machine 600 is controlled using the command. A control parameter may include, e.g., a velocity control parameter, an electric current control parameter, a position control parameter, etc. A velocity control parameter may include, e.g., a commanded or otherwise set velocity (e.g., a target velocity for a control loop) that may be used to affect a velocity of a component of the power machine 600. An electric current control parameter may include, e.g., a commanded or otherwise set electric current (e.g., a target electric current for a control loop) that may be used to affect an electric current of a component of the power machine 600. A position control parameter may include, e.g., a commanded or otherwise set position (e.g., a target position for a control loop) that may be used to affect a position of a component of the power machine 600.

A control scheme may include, e.g., an electric current control scheme, a velocity control scheme, a position control scheme, etc. For instance, when operating pursuant to an electric current control scheme, electric current may be used to control operation of the power machine 600, with control being affected using an electric current control parameter. For example, rather than a target velocity or target position, movement of an electric actuator can be controlled based on a target electric current. When operating in a velocity control scheme, velocity may be used to control operation of the power machine 600, with control being affected using a velocity control parameter. For example, rather than a target electric current or target position, movement of an electric actuator can be controlled based on a target velocity. When operating in a position control scheme, position may be used to control operation of the power machine 600, with control being affected using a position control parameter. For example, rather than a target velocity or target electric current, movement of an electric actuator can be controlled based on a target position.

Accordingly, the application 720 (when executed by the electronic processor 700) may implement a velocity control scheme, an electric current control scheme, or a position control scheme to affect control of the workgroup electric actuator(s) 660 using a velocity control parameter, an electric current control parameter, or a position control parameter, respectively. In some configurations, the application 720 (when executed by the electronic processor 700) may facilitate force balancing for a set of cooperating workgroup electric actuators 660 (e.g., a pair of electric lift actuators or a pair of electric tilt actuators).

Figure 8:
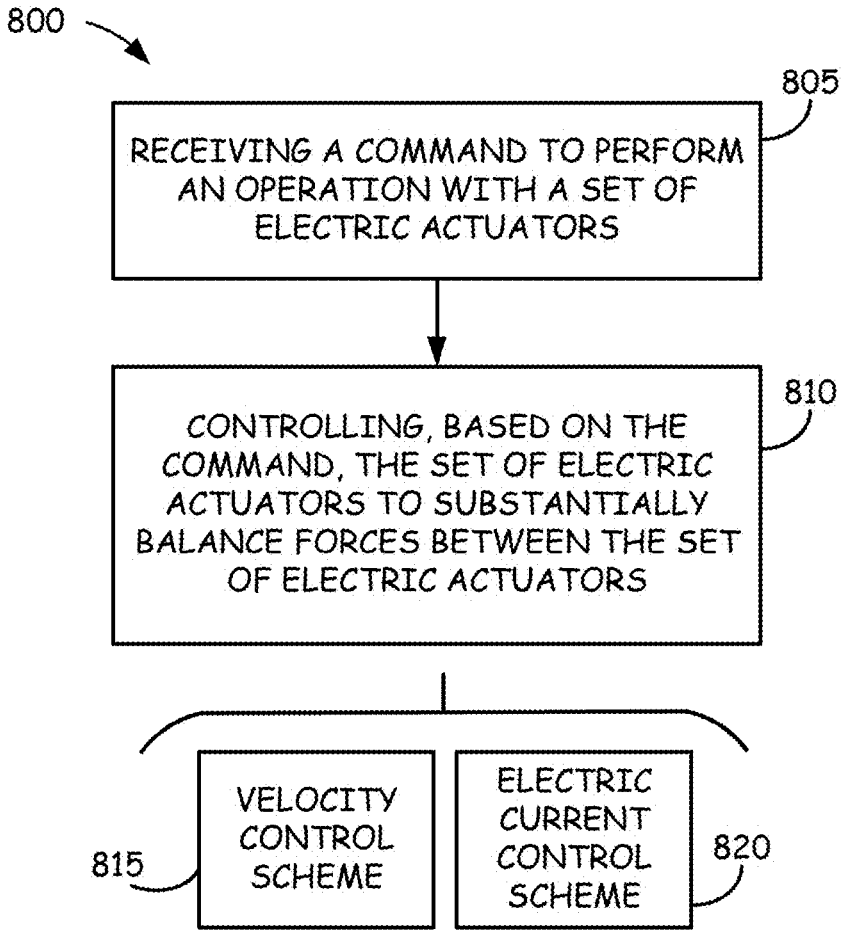
FIG. 8 is a flowchart for controlling a power machine according to some configurations.

FIG. 8 is a flowchart illustrating a method 800 for controlling a power machine (e.g., the power machine 600) according to some configurations. In some configurations, the method 800 can be performed by the control system 610 (e.g., the controller 690) and, in particular, by the electronic processor 700 of the controller 690. However, as noted above, the functionality described with respect to the method 800 may be performed by other devices or can be distributed among a plurality of devices or components (e.g., one or more electronic processors).

As illustrated in FIG. 8, the method 800 may include receiving a command to perform an operation with a plurality of electric actuators (e.g., the workgroup electric actuator(s) 660) (at block 805). In some configurations, the operation may be a digging operation, a trenching operation, a roading operation, etc. In some configurations, the command may be an operator command received via the operator input device(s). Accordingly, in some instances, the electronic processor 700 may receive the command from the operator input device(s).

The command may control the lift arm 670, the work element 655, or another component of the power machine 600. In some examples, the command may include a command for controlling the work element 655 with the workgroup electric actuator(s) 660. For example, the command may be a tilt command to perform a tilt operation with the work element 655 by controlling the electric tilt actuator(s) 680 to adjust a tilt angle of the work element 655. In some examples, the command may include a command for controlling the lift arm 670 with the workgroup electric actuator (s) 660. For example, the command may be a lift command to perform a lift operation with the lift arm 670 by controlling the electric lift actuator(s) 675 to raise or lower the lift arm.

In some examples, performance of the operation may involve cooperatively controlling multiple workgroup electric actuators 660, such as, e.g., a set or pair of workgroup electric actuators 660 (e.g., first and second electric tilt actuator, first and second electric lift actuators, or another number of workgroup electric actuators working cooperatively to perform an operation). For example, when the command is a tilt command to adjust a tilt angle between the work element 655 and the lift arm 670, a set of electric tilt actuators 680 (e.g., a first electric tilt actuator and a second electric tilt actuator, or another number of electric tilt actuators working cooperatively to perform the tilt operation) may cooperatively adjust the tilt angle between the work element 655 and the lift arm 670 synchronously. As another example, when the command is a lift command to raise the lift arm 670, a set of electric lift actuators 675 (e.g., a first electric lift actuator and a second electric lift actuator, or another number of electric lift actuators working cooperatively to perform the lift operation) may be controlled such that each electric lift actuator 675 synchronously acts on a common load (e.g., the lift arm 670, the work element 655, etc.) to perform the lift operation.

As illustrated in FIG. 8, the electronic processor 700 may control the set of workgroup electric actuators 660, based on the command, to substantially balance forces between the set of workgroup electric actuators 660 (at block 810). In other words, the electronic processor 700 may control the set of workgroup electric actuator(s) 660 to perform the operation such that forces exerted by the set of workgroup electric actuators 660 are substantially balanced (i.e., are within +5% of each other, inclusive). In some configurations, in order to provide force balancing for a set of workgroup electric actuators 660, the electronic processor 700 may individually control one or more workgroup electric actuator 660 included in the set of workgroup electric actuators 660 such that force exerted by one workgroup electric actuator 660 is substantially the same as another workgroup electric actuator 660 (e.g., a first force exerted by a first workgroup electric actuator is substantially the same as a second force exerted by a second workgroup electric actuator).

As illustrated in FIG. 8, to balance forces between the set of workgroup electric actuators 660 (e.g., at block 810), the electronic processor 700 may implement a particular control scheme, such as, e.g., a velocity control scheme 815 or an electric current control scheme 820. As generally described in greater detail herein, a velocity control scheme (e.g., the velocity control scheme 815) may include affecting control of a component by controlling a velocity (as a velocity control parameter) of that component. In contrast, an electric current control scheme (e.g., the electric current control scheme 820) may include affecting control of a component by controlling an electric current (as an electric current control parameter) of that component. In some configurations, the electronic processor 700 may implement the same control scheme for each workgroup electric actuator 660 included in the set of workgroup electric actuators 660. Alternatively, in some configurations, the electronic processor 700 may implement different control schemes for different actuators in the set of workgroup electric actuators 660. As one example, the electronic processor 700 may implement the velocity control scheme 815 for a first workgroup electric actuator and the electric current control scheme 820 for a second workgroup electric actuator. As another example, the electronic processor 700 may implement an electric current control scheme 820 for each workgroup electric actuator 660 included in the set of workgroup electric actuators 660.

Figure 9:
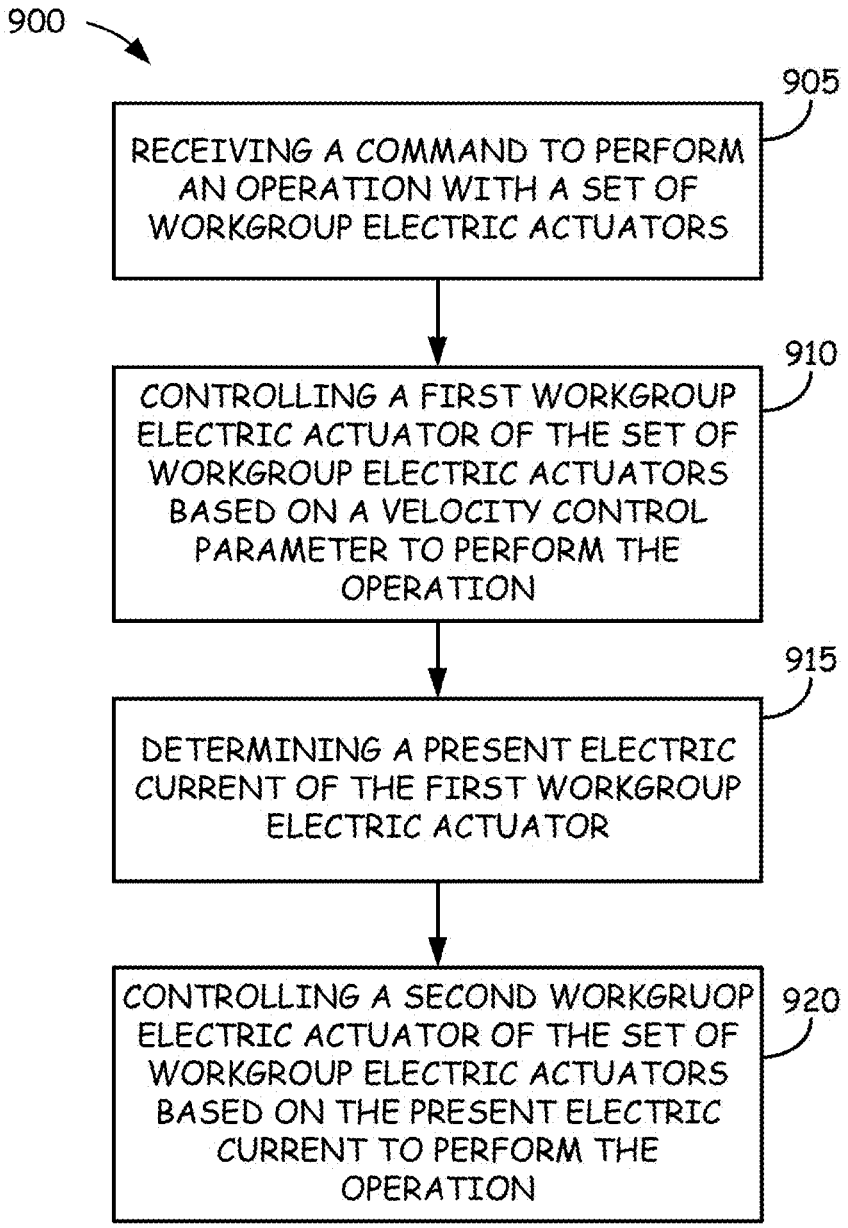
FIG. 9 is a flowchart for a method of balancing forces between a set of electric actuators of the power machine according to some configurations.
Figure 10:
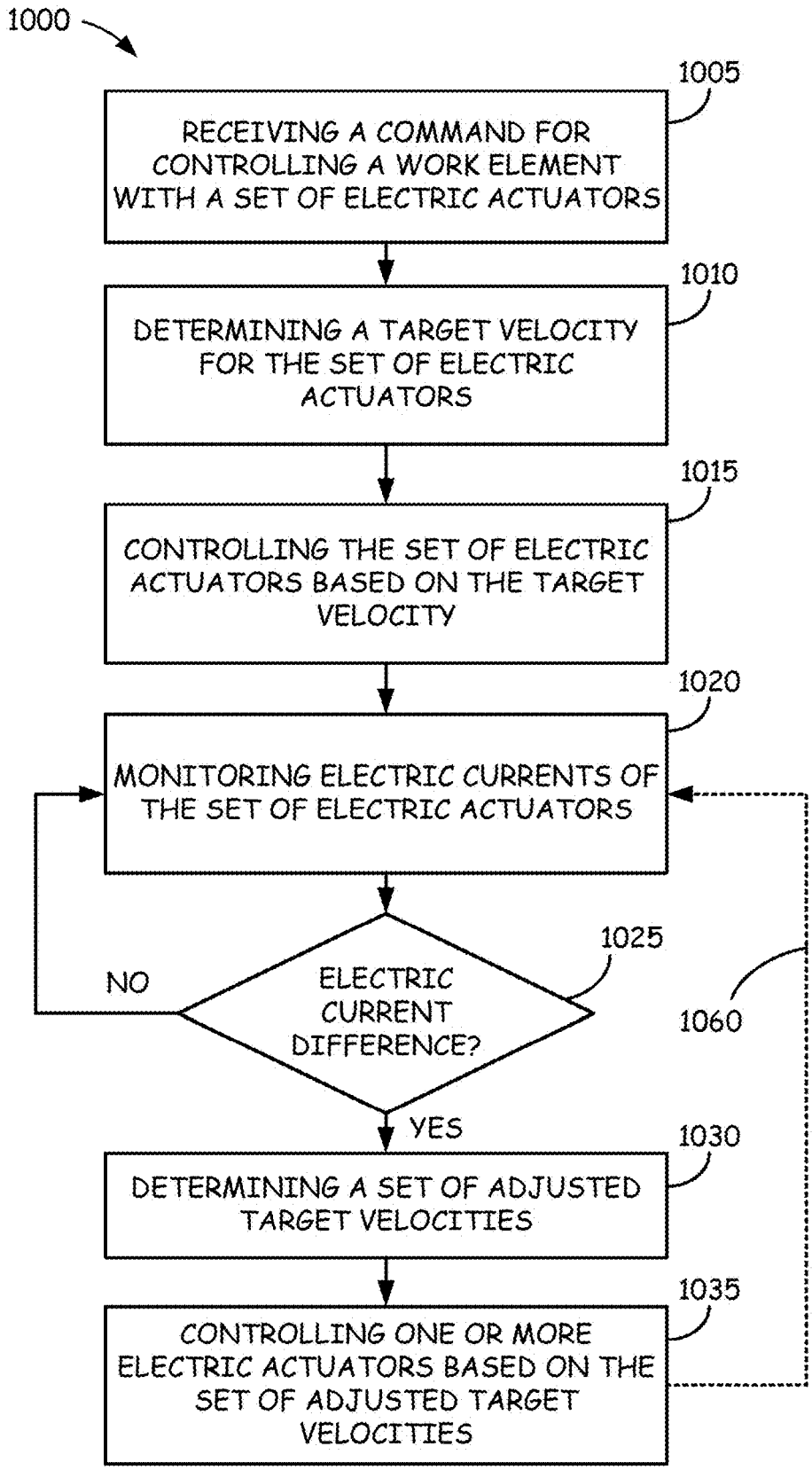
FIG. 10 is a flowchart for another method of balancing forces between a set of electric actuators of the power machine according to some configurations.
Figure 11:
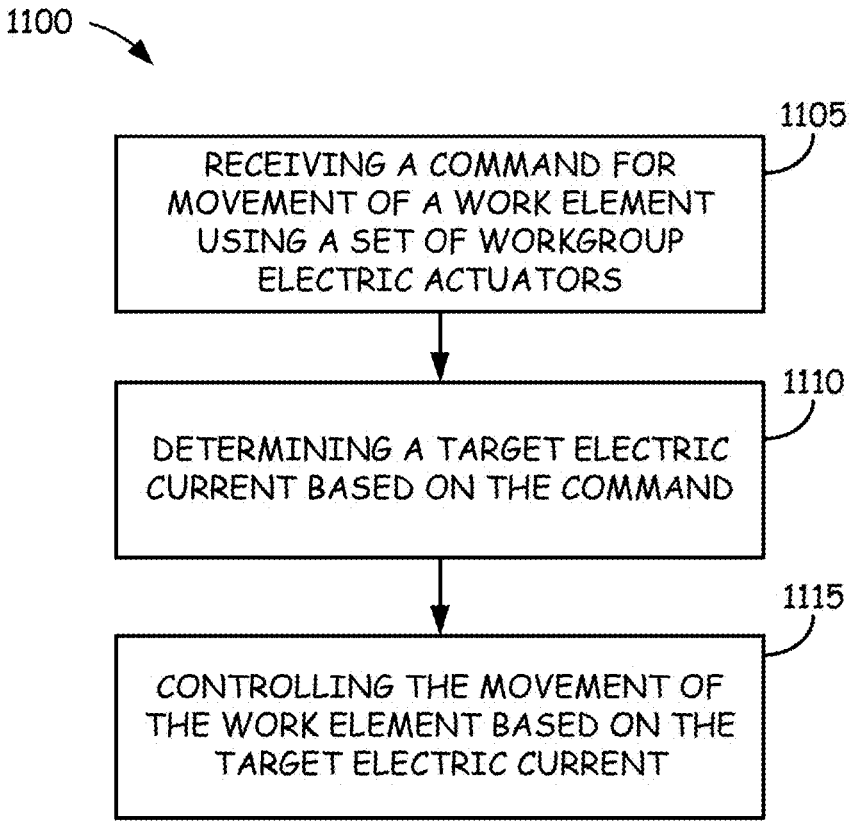
FIG. 11 is a flowchart for yet another method of balancing forces between a set of electric actuators of the power machine according to some configurations.

FIGS. 9-11 are flowcharts illustrating example force balancing control methods according to some configurations. The electronic processor 700 may implement one or more of the force balancing control methods of FIGS. 9-11 to balance (or substantially balance) forces between a set of workgroup electric actuators 660 while performing an operation with the power machine 600. For example, the electronic processor 700 may implement one or more of the force balancing control methods of FIGS. 9-11 to perform a lift operation with a set of electric lift actuators 675 such that forces between the set of electric lift actuators 675 are substantially balanced during performance of the lift operation (e.g., each electric lift actuator 675 provides the same or substantially the same force on the lift arm 670). As another example, the electronic processor 700 may implement one or more of the force balancing control methods of FIGS. 9-11 to perform a tilt operation with a set of electric tilt actuators 680 such that forces between the set of electric tilt actuators 680 are substantially balanced during performance of the tilt operation (e.g., each electric tilt actuator 680 provides the same or substantially the same force on the work element 655).

FIG. 9 is a flowchart illustrating a method 900 for balancing forces between a set of electric actuators of the power machine 600 according to some configurations. In some configurations, the method 900 can be performed by the control system 610 (e.g., the controller 690) and, in particular, by the electronic processor 700 of the controller 690. However, as noted above, the functionality described with respect to the method 900 may be performed by other devices or can be distributed among a plurality of devices or components (e.g., one or more electronic processors).

As illustrated in FIG. 9, the method 900 may include receiving a command to perform an operation with a set of workgroup electric actuators 660 (at block 905). In some configurations, the electronic processor 700 may receive the command to perform an operation as similarly described with respect to block 915 of the method 900. For example, in some configurations, the electronic processor 700 may receive a command to perform an operation with a first workgroup electric actuator and a second workgroup electric actuator (e.g., as the set of workgroup electric actuators 660).

The electronic processor 700 may control one of the workgroup electric actuators 660 (e.g., the first workgroup electric actuator) based on a velocity control parameter to perform the operation (at block 910). In other words, the electronic processor 700 may implement a velocity control scheme for controlling the first workgroup electric actuator to perform the operation. For example, the electronic processor 700 may determine a target velocity for the first workgroup electric actuator, and may control the first workgroup electric actuator by controlling a velocity of the first workgroup electric actuator based on the target velocity. In some configurations, the electronic processor 700 may determine the velocity control parameter based on the commanded operation (e.g., the command received at block 905). For instance, the velocity used to control the first workgroup electric actuator may be a velocity for performing the operation as commanded (e.g., a commanded velocity).

During controlled operation of the first workgroup electric actuators, the electronic processor 700 may determine a present electric current of the first workgroup electric actuator (at block 915). For example, the electronic processor 700 may determine the present electric current of the first workgroup electric actuator while the first workgroup electric actuator is controlled, via the velocity control parameter, to perform the operation. Accordingly, the present electric current of the first workgroup electric actuator may represent an electric current associated with performing the operation under a velocity control scheme. The electronic processor 700 may determine the present electric current of the first workgroup electric actuator based on an operator command or input associated with operating the power machine 600, sensed operation data associated with the power machine 600, or a combination thereof. For example, the electronic processor 700 may determine the present electric current of the first workgroup electric actuator based on electric current data or information collected by the workgroup electric current sensor(s) 668.

Continuing, the present electric current of the first workgroup electric actuator can then be used to determine a target electric current of the second workgroup electric actuator. For example, the present electric current of the first workgroup electric actuator (as determined at block 915) may be set as a target electric current for a second workgroup electric actuator of the set of workgroup electric actuators 660. The electronic processor 700 may then control the second workgroup electric actuator based on the target electric current to perform the operation (at block 920). Accordingly, in some configurations, the electronic processor 700 may implement an electric current control scheme for the second workgroup electric actuator, where the electric current control parameter used to control the second workgroup electric actuator is (or is determined based on) the present electric current (e.g., the target electric current) of the first workgroup electric actuator (e.g., as determined at block 915).

Therefore, according to the force balancing method of FIG. 9, the electronic processor 700 may balance forces between the set of workgroup electric actuators 660 by implementing a first workgroup electric actuator in a velocity control mode and a second workgroup electric actuator in an electric current control mode. In other words, for example, the first workgroup electric actuator can be controlled based on a commanded velocity, a current that corresponds to a force actually applied by the first workgroup electric actuator can be determined, and then the second workgroup electric actuator can be controlled to provide a matching force (e.g., rather than a matching velocity or position). In some configurations, the electronic processor 700 may determine a present electric current for the first workgroup electric actuator (e.g., while controlled via a velocity control parameter) and synchronously control the second workgroup electric actuator in a force (i.e., current) control scheme until an electric current of the second workgroup electric actuator is substantially similar to or the same as the present electric current of the first workgroup electric actuator. The present electric currents of the first workgroup electric actuator and the second workgroup electric actuator being substantially similar to or the same may indicate that the forces between the first workgroup electric actuator and the second workgroup electric actuators are substantially balanced. Correspondingly, in some cases, both electric actuators can then be controlled based on a common control scheme (e.g., in a velocity control mode) when the forces are determined to be balanced.

As one example, an operator of the power machine 600 may provide a lift command for raising or lowering the lift arm 670 using a first electric lift actuator and a second electric lift actuator (e.g., as a set of electric lift actuators 675 configured to synchronously act on a common load, such as the lift arm 670). Responsive to receiving the lift command, the electronic processor 700 may control the first electric lift actuator based on a target velocity associated with the lift command (e.g., the velocity control parameter). The electronic processor 700 may then determine a present electric current of the first electric lift actuator during operation based on the velocity control parameter, and the present electric current of the first electric lift actuator may be utilized as a target electric current for a second electric lift actuator. The electronic processor 700 may thus use the target electric current (e.g., the present electric current of the first electric lift actuator) to control the second electric lift actuator (e.g., as an electric current control parameter). As such, by controlling the electric current of the second electric lift actuator to substantially match the electric current of the first electric lift actuator, the electronic processor 700 can substantially balance forces between the set of electric lift actuators 675 such that each electric lift actuator 675 exerts the same or substantially the same force on the common load (e.g., the lift arm 670).

Accordingly, in some configurations, the electronic processor 700 may control a first electric actuator in a velocity control scheme and a second electric actuator in an electric current control scheme. In particular, according to the force balancing method of FIG. 9, the electronic processor 700 may determine an electric current in the first electric actuator and control the electric current in the second electric actuator such that the electric currents of the first and second electric actuators are substantially the same, thereby substantially balancing forces between the first and second electric actuators.

FIG. 10 is a flowchart illustrating a method 1000 for balancing forces between a set of electric actuators of the power machine 600 according to some configurations. In some configurations, the method 1000 can be performed by the control system 610 (e.g., the controller 690) and, in particular, by the electronic processor 700 of the controller 690. However, as noted above, the functionality described with respect to the method 1000 may be performed by other devices or can be distributed among a plurality of devices or components (e.g., one or more electronic processors).

As illustrated in FIG. 10, the method 1000 may include receiving a command for controlling the work element 655 with a set of electric actuators (e.g., the workgroup electric actuators (at block 1005). In some configurations, the electronic processor 700 may receive the command to for controlling the work element 655 with the set of electric actuators as similarly described with respect to block 915 of the method 900. For example, in some configurations, the electronic processor 700 may receive a command to control the work element 655 with a first workgroup electric actuator and a second workgroup electric actuator (e.g., as the set of workgroup electric actuators 660).

The electronic processor 700 may determine a target velocity for the set of workgroup electric actuators 660 (at block 1010). The electronic processor 700 may determine the target velocity based on the received command (e.g., at block 1005). In some configurations, the target velocity is associated with a velocity for performing the commanded operation (e.g., a commanded velocity). The electronic processor 700 may then control the set of electric actuators based on the target velocity (at block 1015). For instance, the electronic processor 700 may adjust a control signal to the set of workgroup electric actuators 660, based on deviation of the electric actuators 660 from the target velocity. Accordingly, in some configurations, the electronic processor 700 may control the set of electric actuators using a velocity control parameter, where the velocity control parameter is associated with performing a commanded operation (e.g., the velocity control parameter is the target velocity).

While controlling the set of workgroup electric actuators 660 based on the target velocity, the electronic processor 700 may monitor electric currents of the set of workgroup electric actuators 660 (at block 1020). For instance, the electronic processor 700 may monitor an electric current for one of the workgroup electric actuators of the set of workgroup electric actuators 660 (e.g., a present electric current for a first workgroup electric actuator). Alternatively, the electronic processor 700 may monitor an electric current for each of the workgroup electric actuators included in the set of workgroup electric actuators 660. Accordingly, in some configurations, the electronic processor 700 may determine a present electric current for one or more of the workgroup electric actuators included in the set of workgroup electric actuators 660. The electronic processor 700 may determine a present electric current based on an operator command or input associated with operating the power machine 600, sensed operation data associated with the power machine 600 (e.g., electric current information collected via the workgroup electric current sensor(s) 668), etc.

To effect force balancing, in particular, the electronic processor 700 may monitor the electric currents of the set of workgroup electric actuators 660 in order to determine (or detect) an electric current difference between the electric currents for the electric actuators included in the set of workgroup electric actuators 660 (at block 1025). For example, the electronic processor 700 may determine a first present electric current for a first electric actuator and a second present electric current for a second electric actuator. The electronic processor 700 may then compare the first present electric current and the second electric current to determine an electric current difference. The electronic processor 700 may thus detect an electric current difference when the first present electric current and the second electric current are not the same or sufficiently similar. Accordingly, in some configurations, the electronic processor 700 may detect an electric current difference when the difference between electric currents (e.g., the first electric current and the second electric current) exceed a tolerance threshold (e.g., fall outside of an acceptable tolerance amount or range).

When an electric current difference is not detected (i.e., "No" at block 1025), the electronic processor 700 may repeat (or recursively perform) one or more of the illustrated operations of the method 1000. For example, when there is no electric current difference detected between the electric actuators of the set of workgroup electric actuators 660, the electronic processor 700 may continue to control the set of workgroup electric actuators 660 based on the target velocity (e.g., at block 1015), continue to monitor electric currents of the set of workgroup electric actuators 660 to detect electric current differences (e.g., at blocks 1020 and 1025), etc.

When an electric current difference is detected (i.e., "Yes" at block 1025), the electronic processor 700 may determine a set of adjusted target velocities (at block 1030) based on the electric current difference, and control one or more electric actuators of the set of workgroup electric actuators 660 based on the set of adjusted target velocities (at block 1035). In some configurations, the electronic processor 700 may determine an adjusted target velocity for each electric actuator included in the set of workgroup electric actuators 660 (e.g., a first adjusted target velocity for a first electric actuator, a second adjusted target velocity for a second electric actuator, etc.). Alternatively, the electronic processor 700 may determine an adjusted target velocity for a single electric actuator include din the set of workgroup electric actuators 660.

As noted above, the electronic processor 700 may determine an adjusted target velocity based on an electric current difference. Thus, for example, when an electric current difference is present, as may correspond to an undesired force imbalance, the target velocities of one or more of the actuators can be adjusted accordingly, to change the relative movement of the actuators and thereby reduce the current (and force) imbalance. As one example, for a first electric actuator, the electronic processor 700 may determine a change in velocity for the first electric actuator using the following equation: Change in Velocity=(Electric Current of Second Electric Actuator-Electric Current of First Electric Actuator)×Velocity Gain. The electronic processor 700 may then determine the adjusted target velocity for the first electric actuator based on the change in velocity (e.g., either increasing or decreasing the target velocity by the change in velocity). As another example, for a second electric actuator, the electronic processor 700 may determine a change in velocity for the second electric actuator using the following equation: Change in Velocity=(Electric Current of First Electric Actuator-Electric Current of Second Electric Actuator)×Velocity Gain. The electronic processor 700 may then determine the adjusted target velocity for the second electric actuator based on the change in velocity (e.g., either increasing or decreasing the target velocity by the change in velocity). Thus, for example, when the forces at the first electric actuator exceed the forces at the second electric actuator, a positive change in velocity may be commanded at the second electric actuator and a negative change in velocity may be commanded at the first electric actuator, so that the second electric actuator effectively catches up to the first electric actuator and the forces on the actuators are correspondingly brought more into balance.

In some configurations, the electronic processor 700 may determine an adjusted target velocity based on a velocity gain that is a function of the electric current difference. For example, a larger velocity gain may be applied when there is a larger force imbalance, as indicated by a larger electric current difference, and a smaller velocity gain may be applied when there is a smaller force imbalance, as indicated by a smaller electric current difference.

As illustrated in FIG. 10, in some instances, the electronic processor 700 may repeat (or recursively perform) one or more of the illustrated operations of the method 1000. For example, after controlling the set of electric actuators based on the adjusted target velocities (e.g., at block 1035), the method 1000 may return to block 1020 (represented in FIG. 10 by dashed lines 1060), where the electronic processor 700 may monitor electric currents of the set of workgroup electric actuators 660 (at block 1020) in order to detect electric current differences (at block 1025). The electronic processor 700 may then repeat either block 1020 or blocks 1030 and 1035. Accordingly, in some instances, the electronic processor 700 may continuously execute one or more operations of the method 1000 such that the electronic processor 700 continuously balances forces between the set of workgroup electric actuators 660 (e.g., while the power machine 600 performs the commanded operation, etc.).

In some configurations, the electronic processor 700 may repeat one or more operations of the method 1000 intermittently or periodically (e.g., at a predetermined frequency). For instance, in some configurations, the electronic processor 700 may periodically monitor the electric currents of the set of workgroup electric actuators 660 (at block 1020) to detect electric current differences (at block 1025) at a predetermined frequency, such as, e.g., at a predetermined frequency of about 100 Hz.

Accordingly, in some configurations, the electronic processor 700 may implement force balancing between a set of workgroup electric actuators 660 to maintain a force of each electric actuator to be the same or substantially the same, as the set of electric actuators act on a load (e.g., the lift arm 670, the work element 655, etc.). According to the method 1000, the electronic processor 700 may (substantially) balance force between the set of workgroup electric actuators 660 by monitoring and adjusting individual target velocities for each respective workgroup electric actuator 660. For instance, for a first electric actuator, the electronic processor 700 may increase (e.g., speed up) or decrease (e.g., slow down) a target velocity for the first electric actuator depending on whether the electric current of the first electric actuator is above or below an electric current of another electric actuator (e.g., a second electric actuator positioned opposite the first electric actuator). Once an electric actuator is substantially matching the electric current of an opposite electric actuator, the electric actuator may follow the target velocity with small adjustments to the speed to maintain the forces substantially balanced (e.g., the same or substantially the same).

FIG. 11 is a flowchart illustrating a method 1100 for controlling a power machine (e.g., the power machine 600) according to some configurations. In some configurations, the method 1100 can be performed by the control system 610 (e.g., the controller 690) and, in particular, by the electronic processor 700 of the controller 690. However, as noted above, the functionality described with respect to the method 1100 may be performed by other devices or can be distributed among a plurality of devices or components (e.g., one or more electronic processors).

As illustrated in FIG. 11, the method 1100 may include receiving a command for movement of the work element 655 using a set of workgroup electric actuators 660 of the power machine 600 (at block 1105). In some configurations, the electronic processor 700 may receive the command to perform an operation, such as, e.g., movement of the work element 655, as similarly described with respect to block 915 of the method 900. For example, in some configurations, the electronic processor 700 may receive a command to perform an operation with a first workgroup electric actuator and a second workgroup electric actuator (e.g., as the set of workgroup electric actuators 660).

The electronic processor 700 may determine a target electric current based on the command (at block 1110). For example, the electronic processor 700 may determine the target electric current based on a difference between a present velocity for the set of workgroup electric actuators 660 and a velocity corresponding to a commanded movement (e.g., the command received at block 1105). Alternatively, or in addition, the electronic processor 700 may determine the target electric current based on a difference between an average present velocity of the set of workgroup electric actuators 660 (or an electric actuator included therein) and a velocity corresponding to the commanded movement (e.g., the command received at block 1105). Generally, in this regard, the electronic processor 700 may employ real time position data from a motor to monitor a present operation of an actuator, with velocity and acceleration being readily determinable as first and second derivatives of the position, and with force and electric current being proportional to acceleration according to basic physical identities and the known operational characteristics of electric motors.

In some configurations, the electronic processor 700 may determine the target electric current based on an average present position of the set of workgroup electric actuators 660 (or an electric actuator included therein). For instance, the electronic processor 700 may receive position data (e.g., from the workgroup position sensor(s) 667) including a present position for each electric actuator included in the set of workgroup electric actuators 660. The electronic processor 700 may then determine an average present position, which the electronic processor 700 may use to determine the target electric current. In such configurations, the electronic processor 700 may convert (or otherwise transform) position information (e.g., the average present position) to relevant velocity information (e.g., by utilizing one or more physics identities).

As illustrated in FIG. 11, the electronic processor 700 may control the movement of the work element 655 based on the target electric current (at block 1115), which may substantially balance forces between the set of workgroup electric actuators 660. For example, the electronic processor 700 may control the movement of the work element 655 by providing substantially equal electric current to each electric actuator included in the set of workgroup electric actuators 660 (e.g., corresponding to a commanded velocity). Notably, this control may thus inherently substantially balance forces exerted by the set of workgroup electric actuators 660 (e.g., the first and second electric actuators) on the work element 655. For example, if operational control of lift actuators based on a target electric current causes a first of the actuators to advance to a position that is ahead of a second of the actuators, the first actuator will start to bear more of the working load of the present operation. In such a case, the control scheme noted above will effectively slow down the first actuator to allow the second actuator to catch up, with a result that force balance can again be achieved and maintained.

In some configurations, when zero velocity is commanded for the work element 655, the electronic processor 700 may determine a holding electric current (e.g., as the target electric current) for maintaining a present position or orientation for the set of workgroup electric actuators 660. In such configurations, the electronic processor 700 may provide the holding current to the set of workgroup electric actuators 660 (e.g., the first and second electric actuators) based on a target position or a target zero velocity.

Accordingly, in some configurations, the electronic processor 700 may implement force balancing between a set of workgroup electric actuators 660 to maintain a force of each electric actuator the same or substantially the same as the set of electric actuators act on a load (e.g., the lift arm 670, the work element 655, etc.). According to the method 1100, the electronic processor 700 may control (e.g., maintain) electric currents to be substantially similar or the same for each electric actuator included in the set of workgroup electric actuators 660 (e.g., providing the same commanded electric current to each electric actuator).

In some implementations of the force balancing control method of FIG. 11, present position and velocity for the electric actuators may be averaged to determine a single control parameter (e.g., electric current control parameter). In some configurations, a proportional integral derivative (PID) control can be used to control the velocity of the electric actuators by, e.g., controlling the electric currents. For instance, force may be proportional to the amount of current in the actuator motors. Therefore, by controlling the electric current, the velocity of the electric actuators may be controlled.

Thus, examples of the disclosed systems and methods can provide for improved operation of sets of electric actuators for a power machine. For example, as further detailed above, cooperating sets of actuators can be controlled based on mixed or unified control schemes so that forces applied by the actuators are substantially balanced, with corresponding benefits for case and efficiency of operation and for actuator health and lifespan.

It is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, unless otherwise noted, features or functionality of any particular example presented herein can be substituted into or otherwise combined with other examples, including to supplement or replace various features or functionality of the other examples.

Likewise, unless otherwise specified or limited, the terms "mounted," "connected," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

Unless otherwise specified or limited, the terms "about" and "approximately," as used herein with respect to a reference value, refer to variations from the reference value of +20% or less (e.g., +15, +10%, +5%, etc.), inclusive of the endpoints of the range. Similarly, as used herein with respect to a reference value, the term "substantially equal" (and the like) refers to variations from the reference value of +5% or less (e.g., +2%, +1%, +0.5%) inclusive. Where specified in particular, "substantially" can indicate a variation in one numerical direction relative to a reference value. In particular, the term "substantially less" than a reference value (and the like) indicates a value that is reduced from the reference value by 30% or more (e.g., 35%, 40%, 50%, 65%, 80%), and the term "substantially more" than a reference value (and the like) indicates a value that is increased from the reference value by 30% or more (e.g., 35%, 40%, 50%, 65%, 80%). Thus, for example, "substantially balanced forces" and the like, with respect to two actuators, indicates that forces at a first of the actuators are within +5% (inclusive) of forces at a second of the actuators.

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C.

In some implementations, devices or systems disclosed herein can be utilized, manufactured, installed, etc. using methods embodying aspects of the disclosed technology. Correspondingly, unless otherwise indicated, any description herein of particular features, capabilities, or intended purposes of a device or system should be considered to disclose, as examples of the disclosed technology a method of using such devices for the intended purposes, a method of otherwise implementing such capabilities, a method of manufacturing relevant components of such a device or system (or the device or system as a whole), and a method of installing disclosed (or otherwise known) components to support such purposes or capabilities. Similarly, unless otherwise indicated, discussion herein of any method of manufacturing or using for a particular device or system, including installing the device or system, should be understood to disclose, as examples of the disclosed technology, the utilized features and implemented capabilities of such device or system.

Some methods of the disclosed technology may be presented above or below with operations listed in a particular order. Unless otherwise required or specified, the operations of such methods can be implemented in different orders, in parallel, or as selected sub-sets of one or more individual operations (e.g., with a particular listed operation being implemented alone, rather than in combination with others).

Unless otherwise specifically indicated, ordinal numbers are used herein for convenience of reference, based generally on the order in which particular components are presented in the relevant part of the disclosure. In this regard, for example, designations such as "first," "second," etc., generally indicate only the order in which a thus-labeled component is introduced for discussion and generally do not indicate or require a particular spatial, functional, temporal, or structural primacy or order. Relatedly, similar or identical components may be referred to with different ordinal numbers in different contexts.

In some embodiments, aspects of the technology disclosed herein, including computerized implementations of methods according to the technology disclosed herein, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein. Accordingly, for example, embodiments of the technology disclosed herein can be implemented as a set of instructions, tangibly embodied on a non-transitory computer-readable media, such that a processor device can implement the instructions based upon reading the instructions from the computer-readable media. Some embodiments of the technology disclosed herein can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.). In some embodiments, a control device can include a centralized hub controller that receives, processes and (re) transmits control signals and other data to and from other distributed control devices (e.g., an engine controller, an implement controller, a drive controller, etc.), including as part of a hub-and-spoke architecture or otherwise.

The term "article of manufacture" as used herein is intended to encompass a computer program accessible from any computer-readable device, carrier (e.g., non-transitory signals), or media (e.g., non-transitory media). For example, computer-readable media can include but are not limited to magnetic storage devices (e.g., hard disk, floppy disk, magnetic strips, and so on), optical disks (e.g., compact disk (CD), digital versatile disk (DVD), and so on), smart cards, and flash memory devices (e.g., card, stick, and so on). Additionally, it should be appreciated that a carrier wave can be employed to carry computer-readable electronic data such as those used in transmitting and receiving electronic mail or in accessing a network such as the Internet or a local area network (LAN). Those skilled in the art will recognize that many modifications may be made to these configurations without departing from the scope or spirit of the claimed subject matter.

Certain operations of methods according to the technology disclosed herein, or of systems executing those methods, may be represented schematically in the FIGS. or otherwise discussed herein. Unless otherwise specified or limited, representation in the FIGS. of particular operations in particular spatial order may not necessarily require those operations to be executed in a particular sequence corresponding to the particular spatial order. Correspondingly, certain operations represented in the FIGS., or otherwise disclosed herein, can be executed in different orders than are expressly illustrated or described, as appropriate for particular embodiments of the technology disclosed herein. Further, in some embodiments, certain operations can be executed in parallel, including by dedicated parallel processing devices, or separate computing devices configured to interoperate as part of a large system.

As used herein in the context of computer implementation, unless otherwise specified or limited, the terms "component," "system," "module," "block," and the like are intended to encompass part or all of computer-related systems that include hardware, software, a combination of hardware and software, or software in execution. For example, a component may be, but is not limited to being, a processor device, a process being executed (or executable) by a processor device, an object, an executable, a thread of execution, a computer program, or a computer. By way of illustration, both an application running on a computer and the computer can be a component. One or more components (or system, module, and so on) may reside within a process or thread of execution, may be localized on one computer, may be distributed between two or more computers or other processor devices, or may be included within another component (or system, module, and so on).

Although the technology disclosed herein has been described with reference to preferred embodiments, workers skilled in the art will recognize that changes may be made in form and detail to the disclosed embodiments without departing from the spirit and scope of the concepts discussed herein.

What is claimed is:

1. An electric power machine, the electric power machine comprising:

a power machine frame;

a plurality of electric actuators supported by the power machine frame, wherein the plurality of electric actuators includes a set of electric lift actuators and a set of electric tilt actuators;

a lift arm structure that includes:

a lift arm coupled to the power machine frame and configured to be moved relative to the power machine frame by the set of electric lift actuators; and a work element supported by the lift arm and configured to be moved relative to the lift arm by the set of electric tilt actuators;

an electrical power source configured to power the plurality of electric actuators; and one or more electronic processors in communication with the plurality of electric actuators, the one or more electronic processors configured to:

receive a command for movement of the lift arm using the set of electric lift actuators or movement of the work element using the set of electric tilt actuators; and control, based on the command, the set of electric lift actuators or the set of electric tilt actuators to, respectively, substantially balance forces between the set of electric lift actuators or substantially balance forces between the set of electric tilt actuators.

2. The electric power machine of claim 1, wherein the one or more electronic processors are configured to control, based on a target electric current associated with the command for movement, the set of electric lift actuators or the set of electric tilt actuators by:

determining a target electric current based on the command for movement; and providing, based on the target electric current, substantially equal electric current to the set of electric lift actuators or the set of electric tilt actuators to, respectively, substantially balance forces exerted by the set of electric lift actuators or the set of electric tilt actuators.

3. The electric power machine of claim 2, wherein the target electric current is determined based on a difference between (i) a present velocity for at least one of a first electric actuator or a second electric actuator and (ii) a velocity corresponding to the movement, wherein the first electric actuator and the second electric actuator are included in the set of electric lift actuators or the set of electric tilt actuators.

4. The electric power machine of claim 2, wherein the target electric current is determined based on a difference between (i) an average present velocity of at least one of a first electric actuator or a second electric actuator and (ii) a velocity corresponding to the movement, wherein the first electric actuator and the second electric actuator are included in the set of electric lift actuators or the set of electric tilt actuators.

5. The electric power machine of claim 2, wherein the target electric current is based on an average present position of a first electric actuator and a second electric actuator, wherein the first electric actuator and the second electric actuator are included in the set of electric lift actuators or the set of electric tilt actuators.

6. The electric power machine of claim 2, wherein, when zero velocity is commanded for the work element, the one or more electronic processors are configured to provide a holding electric current to a first electric actuator and a second electric actuator based on a target position or a target zero velocity, wherein the first electric actuator and the second electric actuator are included in the set of electric lift actuators or the set of electric tilt actuators.

7. The electric power machine of claim 1, wherein the one or more electronic processors are configured to:

control a first electric actuator of the plurality of electric actuators based on a velocity control parameter to perform the movement;

determine a target electric current for a second electric actuator of the plurality of electric actuators based on a present electric current of the first electric actuator while the first electric actuator is controlled based on the velocity control parameter to perform the movement; and control the second electric actuator based on the target electric current to perform the movement.

8. A method for controlling an electric power machine, the method comprising:

receiving, with one or more electronic processors, a command to perform an operation with a plurality of electric actuators of the electric power machine, the plurality of electric actuators including a first electric actuator and a second electric actuator;

controlling, with the one or more electronic processors, the first electric actuator based on a velocity control parameter to perform the operation;

determining, with the one or more electronic processors, a target electric current for the second electric actuator based on a present electric current of the first electric actuator while the first electric actuator is controlled based on the velocity control parameter to perform the operation; and controlling, with the one or more electronic processors, the second electric actuator based on the target electric current to perform the operation.

9. The method of claim 8, wherein controlling the second electric actuator, with the one or more electronic processors, based on the target electric current substantially balances forces exerted by the first electric actuator and the second electric actuator.

10. The method of claim 8, wherein controlling the first electric actuator, with the one or more electronic processors, based on the velocity control parameter, to perform the operation and controlling the second electric actuator, with the one or more electronic processors, based on the target electric current, to perform the operation includes controlling the first electric actuator and the second electric actuator to synchronously act on a common load as part of performing the operation.

11. The method of claim 8, wherein receiving, with the one or more electronic processors, the command to perform the operation includes receiving a command to control a work element of the electric power machine configured to be synchronously moved by the first electric actuator and the second electric actuator.

12. The method of claim 8, wherein receiving, with the one or more electronic processors, the command to perform the operation includes receiving a lift command to perform a lift operation with a lift arm of the electric power machine, wherein the first electric actuator and the second electric actuator are electric lift actuators arranged to raise and lower the lift arm.

13. The method of claim 8, wherein receiving, with the one or more electronic processors, the command to perform the operation includes receiving a tilt command to perform a tilt operation associated with a work element of the electric power machine, wherein the first electric actuator and the second electric actuator are electric tilt actuators arranged to adjust a tilt angle of the work element.

14. A method for controlling an electric power machine, the method comprising:

receiving, with one or more electronic processors, a command for controlling a work element with a plurality of electric actuators of the electric power machine;

determining, with the one or more electronic processors, a target velocity for the plurality of electric actuators based on the command;

controlling, with the one or more electronic processors, the plurality of electric actuators based on the target velocity;

while controlling the plurality of electric actuators based on the target velocity, monitoring, with the one or more electronic processors, electric currents of a first electric actuator and a second electric actuator of the plurality of electric actuators to detect an electric current difference between the electric currents of the first electric actuator and the second electric actuator; and responsive to detecting the electric current difference:

determining, with the one or more electronic processors, a first adjusted target velocity for the first electric actuator; and controlling, with the one or more electronic processors, the first electric actuator based on the first adjusted target velocity.

15. The method of claim 14, further comprising:

responsive to detecting, with the one or more electronic processors, the electric current difference:

determining, with the one or more electronic processors, a second adjusted target velocity for the second electric actuator; and controlling, with the one or more electronic processors, the second electric actuator based on the second adjusted target velocity.

16. The method of claim 14, wherein monitoring, with the one or more electronic processors, the electric currents of the first electric actuator and the second electric actuator includes monitoring the electric currents of the first electric actuator and the second electric actuator at a predetermined frequency.

17. The method of claim 16, wherein monitoring, with the one or more electronic processors, the electric currents of the first electric actuator and the second electric actuator at a predetermined frequency includes monitoring the electric currents of the first electric actuator and the second electric actuator at the predetermined frequency of about 100 Hz.

18. The method of claim 14, further comprising:

determining, with the one or more electronic processors, that the electric current difference exceeds a tolerance threshold, wherein the first electric actuator is controlled based on the first adjusted target velocity in response to determining that the electric current difference exceeds the tolerance threshold.

19. The method of claim 14, wherein determining, with the one or more electronic processors, the first adjusted target velocity for the first electric actuator includes determining the first adjusted target velocity based on a velocity gain, wherein the velocity gain is a function of the electric current difference.

20. The method of claim 14, wherein receiving, with the one or more electronic processors, the command includes receiving a command for controlling a lift arm assembly of the electric power machine that supports the work element, wherein the lift arm assembly includes the first electric actuator arranged at a first side of the lift arm assembly and the second electric actuator arranged as a second side of the work element, the second side of the work element being opposite the first side of the work element.

* * * * *